US008316919B2

(12) United States Patent
Hirata et al.

(10) Patent No.: US 8,316,919 B2
(45) Date of Patent: Nov. 27, 2012

(54) APPARATUS FOR SETTING A CORE IN A MOLDING MACHINE, A MOLDING MACHINE, AND A METHOD FOR SETTING A CORE

(75) Inventors: Minoru Hirata, Toyokawa (JP); Koichi Sakaguchi, Toyokawa (JP)

(73) Assignee: Sintokogio Ltd., Aichi (JP)

( * ) Notice: Subject to any disclaimer, the term of this patent is extended or adjusted under 35 U.S.C. 154(b) by 93 days.

(21) Appl. No.: 12/744,636

(22) PCT Filed: Jan. 26, 2009

(86) PCT No.: PCT/JP2009/051157

§ 371 (c)(1),
(2), (4) Date: May 25, 2010

(87) PCT Pub. No.: WO2009/098955

PCT Pub. Date: Aug. 13, 2009

(65) Prior Publication Data

US 2010/0287759 A1 Nov. 18, 2010

(30) Foreign Application Priority Data

Feb. 4, 2008 (JP) ..... 2008-023626
Jul. 14, 2008 (JP) ..... 2008-182578

(51) Int. Cl.
*B22D 33/04* (2006.01)
*B22C 11/00* (2006.01)

(52) U.S. Cl. ..... 164/340; 29/281.1; 29/281.5; 29/281.6; 164/341; 164/397

(58) Field of Classification Search ..... 29/760, 29/527.1, 650, 428, 732, 281.1, 281.5, 281.6; 164/340, 341, 397
See application file for complete search history.

(56) References Cited

U.S. PATENT DOCUMENTS 6,622,772 B1 * 9/2003 Hunter ..... 164/19
(Continued)

FOREIGN PATENT DOCUMENTS

JP 61-199552 9/1986
(Continued)

*Primary Examiner* — Derris Banks
*Assistant Examiner* — Kaying Kue
(74) *Attorney, Agent, or Firm* — Finnegan, Henderson, Farabow, Garrett & Dunner, L.L.P.

(57) ABSTRACT

The object of the invention is to provide an apparatus for setting a core, a molding machine, and a method for setting a core where the configuration of the apparatus and the machine is simplified and the accuracy of the core-setting is high. The apparatus is one for setting a core in a molding machine that comprises an upper flask, a lower flask, a match plate clamped between the upper flask and the lower flask, and an upper and a lower squeezing member for forming molding spaces by having the upper and lower squeezing members be inserted into the upper and lower flasks, respectively, wherein a core is set in the lower mold in a state that the upper mold, the lower mold, and the match plate are separate from each other, the apparatus comprising: a jig for a core having a means for holding a core and a rotary shaft and being rotatably supported by the rotary shaft wherein the means for holding a core detachably holds the core at the jig; and a carriage for a core for rotatably supporting the rotary shaft of the jig and being transported to and from a position above the lower mold; wherein an actuator for elevating the match plate transported between the upper flask and lower flask elevates the jig for the core and the carriage for the core that are transported to a position above the lower mold, which actuator is attached to the molding machine.

3 Claims, 25 Drawing Sheets

U.S. PATENT DOCUMENTS

| | | | | |
|---|---|---|---|---|
| 6,817,403 | B2 * | 11/2004 | Hunter | 164/169 |
| 6,868,894 | B2 * | 3/2005 | Knudsen | 164/340 |
| 7,104,310 | B2 * | 9/2006 | Hunter | 164/456 |
| 7,784,526 | B2 * | 8/2010 | Harada et al. | 164/201 |
| 8,132,613 | B2 * | 3/2012 | Hirata et al. | 164/397 |
| 2002/0157800 | A1 * | 10/2002 | Kaneto et al. | 164/20 |
| 2009/0121382 | A1 * | 5/2009 | Hirata et al. | 264/219 |
| 2010/0252220 | A1 * | 10/2010 | Hirata et al. | 164/28 |

FOREIGN PATENT DOCUMENTS

| | | |
|---|---|---|
| JP | 5-245582 | 9/1993 |
| WO | WO 02/43901 A1 | 6/2002 |

* cited by examiner

APPARATUS FOR SETTING A CORE IN A MOLDING MACHINE, A MOLDING MACHINE, AND A METHOD FOR SETTING A CORE

TECHNICAL FIELD

The present invention relates to an apparatus for setting a core in a molding machine for molding a pair of upper and lower molds by using a match plate, a molding machine, and a method for setting the core.

BACKGROUND ART

Conventional molding machines, which mold a pair of upper and lower flaskless molds using a match plate, have been disclosed in publications such as International Publication WO 02/43901 (FIG. 3). In the molding machine of this publication, a lower flask is configured to move back and forth. The flask is transported from the machine to set a core by a core-setter, which is located above the flask.

DISCLOSURE OF INVENTION

The machines disclosed in the above publications require that the lower flask be configured to move back and forth. Thus, its configuration becomes complicated. In addition, a core is set under the condition that the lower flask is transported outside the machine, that is, the flask is elevated while it is supported as a cantilever. Thus, no accuracy of the core-setting is maintained. These have been problems.

To solve the problems, the object of the present invention is to provide an apparatus for setting a core, a molding machine, and a method for setting a core that have simple configurations and maintain a high accuracy for the core-setting.

To achieve the object, an apparatus for setting a core of the present invention in a molding machine that comprises an upper flask, a lower flask, a match plate clamped between the upper flask and the lower flask, and an upper and a lower squeezing member for forming molding spaces by being inserted into the upper and lower flasks, respectively, wherein a core is set in the lower mold in a state that the upper mold, the lower mold, and the match plate are separate from each other, the apparatus comprising a jig for a core having a means for holding the core and a rotary shaft and being rotatably supported by the rotary shaft wherein the means for holding the core detachably holds the core at the jig for the core, and a carriage for a core rotatably supporting the rotary shaft and being transported to and from a position above the lower mold; wherein an actuator for elevating the match plate transported to a position between the upper flask and lower flask elevates the carriage for the core and the jig for the core that are transported to a position above the lower mold, which actuator is attached to the molding machine.

The molding machine of the present invention comprises the apparatus for setting a core, wherein mechanisms for transporting a match plate are positioned at each side of a molding station clamping the match plate by the upper flask and the lower flask wherein one mechanism faces the other mechanism, and wherein one of the mechanisms transports the jig for the core and the carriage for the core to and from the position above the lower mold.

To achieve the object, a method for setting a core of the present invention in a molding machine that comprises an upper flask, a lower flask, a match plate clamped between the upper flask and the lower flask, and an upper and a lower squeezing member for forming molding spaces by being inserted into the upper and lower flasks, respectively, wherein a core is set in the lower mold in a state that the upper mold, the lower mold, and the match plate are separate from each other, the method comprising the steps of: holding a core by a jig for a core, the jig having a means for holding a core and a rotary shaft and being rotatably supported by the rotary shaft, the means detachably holding a core at the jig for the core, wherein the core is held by the jig for the core by activating the means for holding the core after placing the core in the jig for the core; rotating the jig for the core to have the core held by the jig face downward; transporting a carriage for a core, which rotatably supports the rotary shaft of the jig, to a position above the lower mold so that the core, which is held by the jig, faces the lower mold; lowering the core held by the jig to abut or nearly abut the lower mold by activating an elevating actuator that is attached to the molding machine and elevates the match plate, which is transported to a position between the upper flask and the lower flask; releasing the core from the means for holding the core to set it on the lower mold while the means is lowered; elevating the carriage for the core and the jig for the core by activating the elevating actuator; and transporting the carriage for the core and the jig for the core away from the position above the lower mold.

The method for setting a core in the molding machine of the present invention is characterized by releasing the core from the means for holding the core while the core that is held by the jig is lowered to abut or nearly abut the lower mold, and pressuring the core with compressed air to set the core on the lower mold.

To achieve the object, the apparatus for setting a core of the present invention in a molding machine that comprises an upper flask, a lower flask, a match plate clamped between the upper flask and the lower flask, and an upper and a lower squeezing member for forming molding spaces by being inserted into the upper and lower flasks, respectively, wherein a core is set in the lower mold in a state that the upper mold, the lower mold, and the match plate are separate from each other, the apparatus comprising: a jig for a core having a means for holding a core wherein the means detachably holds the core at the jig for the core; and a carriage for a core being connected to the jig and being transported to and from a position above the lower mold; wherein an actuator for elevating the match plate transported to a position between the upper flask and the lower flask elevates the carriage for the core and the jig for the core that are transported to a position above the lower mold, which actuator is attached to the molding machine.

The apparatus for setting a core in the molding machine of the present invention further comprises a jig for transporting a core being transported to and from a position below the jig for the core and being elevated.

The molding machine of the present invention is characterized by comprising the apparatus for setting a core, a mechanism for transporting the match plate to and from a position between the upper and lower flasks at one of the sides of a molding station for clamping the match plate by the upper flask and the lower flask, and a mechanism for transporting a jig for the core and the carriage for the core to and from a position above the lower mold at another side, where the mechanism for transporting the jig and the carriage faces the mechanism for transporting the match plate.

A method for setting a core of the present invention in a molding machine that comprises an upper flask, a lower flask, a match plate clamped between the upper flask and the lower flask, and an upper and a lower squeezing member for forming molding spaces by being inserted into the upper and lower flasks, respectively, wherein a core is set in the lower mold in a state that the upper mold, the lower mold, and the match plate are separate from each other, the method comprising the steps of holding a core by a jig for a core, the jig having a means for holding a core for detachably holding a core at the jig for the core, wherein a core is held by the jig for the core by activating the means for holding the core after placing the core in the jig for the core; transporting a carriage for a core, which is connected to the jig, to a position above the lower mold so that the core, which is held by the jig, faces the lower mold; lowering the core held by the jig to abut or nearly abut the lower mold by activating an elevating actuator that is attached to the molding machine and elevates the match plate, which is transported to a position between the upper flask and the lower flask; releasing the core from the means for holding the core to set it on the lower mold while the means is lowered; elevating the carriage for the core and the jig for the core by activating the elevating actuator; and transporting the carriage for the core and the jig for the core away from the position above the lower mold.

Since the apparatus for setting a core of the present invention is used in a molding machine that comprises an upper flask, a lower flask, a match plate clamped between the upper flask and the lower flask, and an upper and a lower squeezing member for forming molding spaces by being inserted into the upper and lower flasks, respectively, wherein a core is set in the lower mold in a state that the upper mold, the lower mold, and the match plate are separate from each other, and is configured to comprise a jig for a core having a means for holding a core and a rotary shaft and being rotatably supported by the rotary shaft wherein the means detachably holds a core at the jig for the core, and a carriage for a core for rotatably supporting the rotary shaft and being transported to and from a position above the lower mold, wherein an actuator for elevating the match plate transported to a position between the upper flask and lower flask elevates the carriage for the core and the jig for the core that are transported to a position above the lower mold, which actuator is attached to the molding machine, the present invention has advantageous effects such as simplifying the configuration of the apparatus and the machine and maintaining a high accuracy in setting a core.

The basic Japanese patent applications No. 2008-023626, filed Feb. 4, 2008 and No. 2008-182578, filed Jul. 14, 2008 are hereby incorporated in their entirety by reference into the present application.

The present invention will become more fully understood from the detailed description given below. However, the detailed description and the specific embodiment are illustrations of desired embodiments of the present invention, and are described only for an explanation. Various changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein, is intended merely to better illuminate the invention, and so does not limit the scope of the invention, unless otherwise claimed.

BEST MODE FOR CARRYING OUT THE INVENTION

Figure 1:
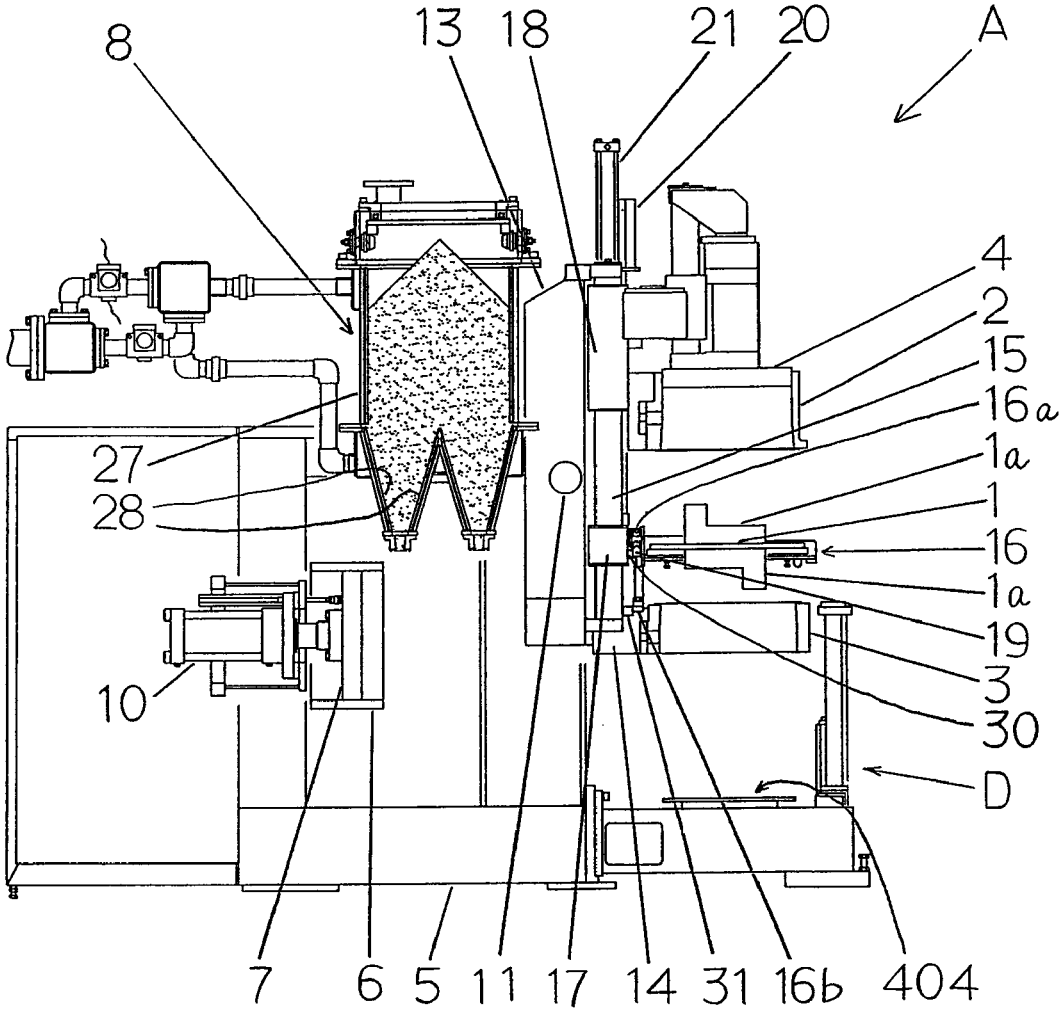
FIG. 1 shows the molding machine as seen from the arrows X-X in FIG. 7.

Below the embodiments of the present invention will be described with reference to the drawings. First, a body A of a molding machine is described. As shown in FIG. 1 (seen from the arrows X-X in FIG. 7), the body A comprises an upper flask 2 and lower flask 3, which together can clamp a match plate 1. The match plate 1 has patterns 1*a*, 1*a* on both sides. The body A comprises an upper squeezing member 4, which can be inserted into the upper flask 2 while facing the match plate 1, an auxiliary flask 6 fixed to a platform 5 in an upright position, and a lower squeezing member 7 directing its pressing plane downward to be inserted into the auxiliary flask 6.

FIG. 1 shows the body A in its initial state. The match plate 1, the upper flask 2, the lower flask 3, and the upper squeezing member 4 are in their horizontal positions. The pressing plane of the squeezing member 4 faces vertically downward. They can integrally rotate to their vertical positions as described below.

The auxiliary flask 6 and squeezing member 7 are fixed in their horizontal positions without rotating. The auxiliary flask 6 is positioned to abut the lower flask 3 when the upper flask 2 and the lower flask 3, which clamp the match plate 1, rotate to their vertical positions. The lower squeezing member 7 can be inserted into the lower flask 3 in its vertical position through the auxiliary flask 6.

A means 8 for introducing molding sand, which is located at the upper center of the body A, fills molding sand into a pair of molding spaces to be formed below it. In FIG. 1, the molding spaces are not formed yet. Near the position below the means 8 for introducing molding sand, a pair of lateral first cylinders (upper cylinders) 9 (see FIGS. 2 and 5) and a lateral second cylinder (lower cylinder) 10 (see FIG. 1) are oppositely provided. The first cylinders 9 and the second cylinder 10 actuate the upper squeezing member 4 and the lower squeezing member 7, respectively. The first and second cylinders 9, 10 are hydraulic cylinders in this embodiment, but may be electric cylinders.

Figure 2:
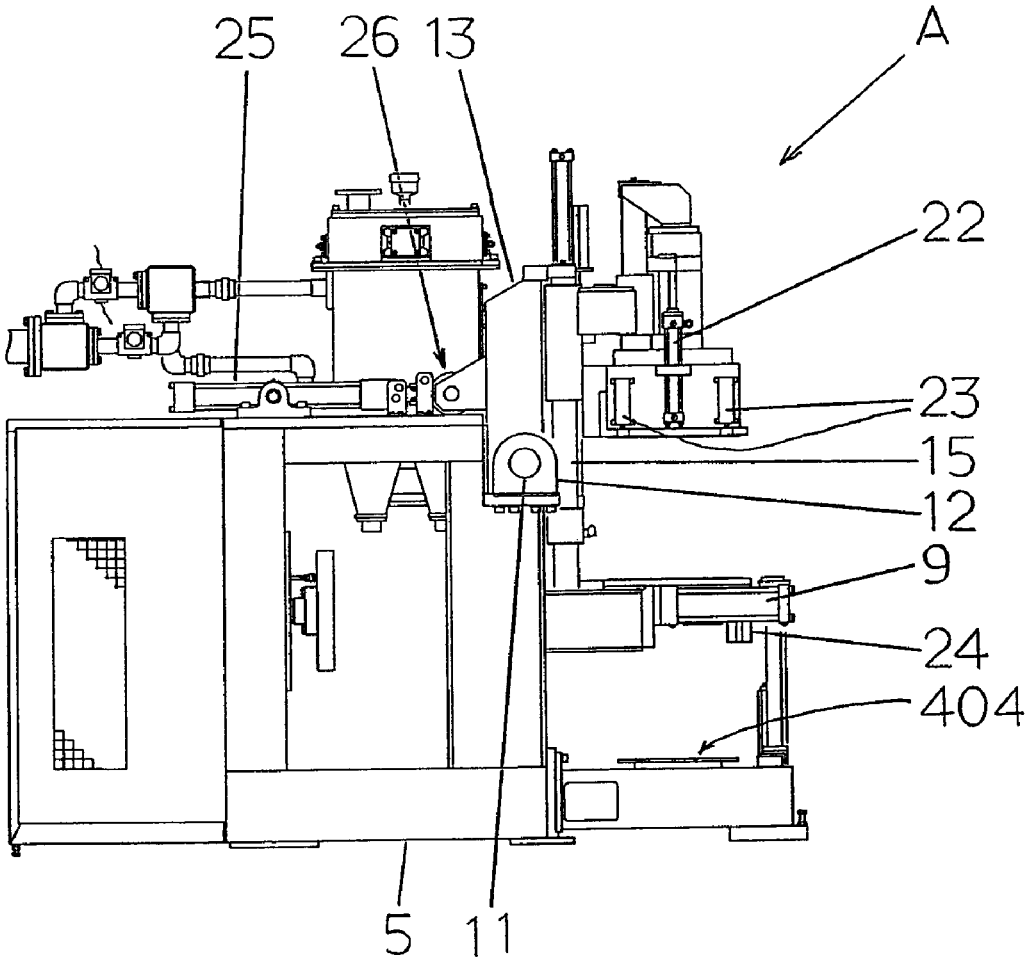
FIG. 2 shows the molding machine as seen from the arrows Y-Y in FIG. 6.

As shown in FIGS. 1 and 2 (seen from the arrows Y-Y in FIG. 6), the rotary shaft 11, located in the upper right part of the platform 5, extends in the longitudinal direction of the body A (the direction perpendicular to the planes of FIGS. 1 and 2). Thus, the front end of the rotary shaft 11 is only shown in FIGS. 1 and 2. The rotary shaft 11 is rotatably supported by a pair of bearings 12 (FIG. 2 shows just the front bearing 12), which are attached to the platform 5 by an appropriate distance. The rotary shaft 11 is provided with a rotary frame 13 near its center. The rotary frame substantially extends in a direction perpendicular to the rotary shaft 11.

As shown in FIG. 1, the lower flask 3, which has a sand filling port in its left wall, is connected to the right bottom part of the rotary frame 13 by means of a supporting member 14. The rotary frame 13 has a pair of guide rods 15 (FIGS. 1 and 2 show just the front guide rod 15) at its right side. The pair of guide rods 15 substantially extend in the vertical direction and are spaced apart by a predetermined distance.

As shown in FIG. 1, a mounting member 16 for placing the match plate 1 above the lower flask 3 and the upper flask 2 above the mounting member 16 are slidably supported on the pair of vertical guide rods 15 by means of guide holders 17 and 18, respectively. The upper flask 2 has a sand-filling port on its left wall. The mounting member 16 is placed on a guide rail 19, which extends in the longitudinal direction of the molding machine. It freely moves along the guide rail 19. The guide rail 19 is attached to the guide holder 17 by means of the mounting frame 30. The lower part of the mounting frame 30 is provided with a rail 31. The side of the rail 31 is contacted by the bottom rollers 16*b*, 16*b* of the mounting member 16, as described below. The guide rail 19, the mounting frame 30, the guide holder 17, and the rail 31 move up and down by extending and contracting a third cylinder 20, which is attached to the rotary frame 13. The upper flask 2 is fixed to a fourth cylinder 21, of which the tip of the piston rod is attached to the rotary frame 13 by means of a supporting member (not shown). The fourth cylinder 21 points downward. Its extension and contraction causes the upper flask 2 to move back and forth with respect to the mounting member 16.

As shown in FIG. 2, a pair of fifth cylinders 22 are disposed at the center between the front and rear sides of the upper flask 2 (FIG. 2 shows just the front side). The pair of fifth cylinders 22 support the upper squeezing member 4 with their piston tips to move it forward and backward with respect to the upper flask 2 by their extension and contraction. Therefore, the fifth cylinders rotate integrally with the upper flask 2 and the upper squeezing member 4. One pair of sixth cylinders 23 are attached to the end of the front side of the upper flask 2. Another pair of sixth cylinders 23 are attached to the end of the back side of the upper flask 2. They point downward and press the upper flask 2 away from the match plate 1. Two seventh cylinders 24 (see FIG. 2) are attached to the outer face of the front side of the lower flask 3 (see FIG. 1). Another two seventh cylinders 24 are attached to the outer face of the back side of the lower flask 3. They point upward and press the lower flask 3 away from the match plate 1. Two of the seventh cylinders can be eliminated by substituting the third cylinders 20 for them. A pair of eighth cylinders 25 are attached to both the front and end sides of the upper plane of the platform 5. They point rightward. The upper parts of the rotary frame 13 are attached to the tips of the piston rods of the pair of eighth cylinders 25 by means of connecting mechanisms 26. It rotates about the rotary shaft 11 by the extension and contraction of the eighth cylinders 25.

As shown in FIG. 2, the means 8 for introducing molding sand of the body A is disposed between the pair of eighth cylinders 25 on the upper plane of the platform 5. As shown in FIG. 1, an injecting mechanism 28 is disposed under a sand tank 27 of the means 8 for introducing molding sand. The injecting mechanism 28 injects compressed air for fluidizing the molding sand.

Figure 3:
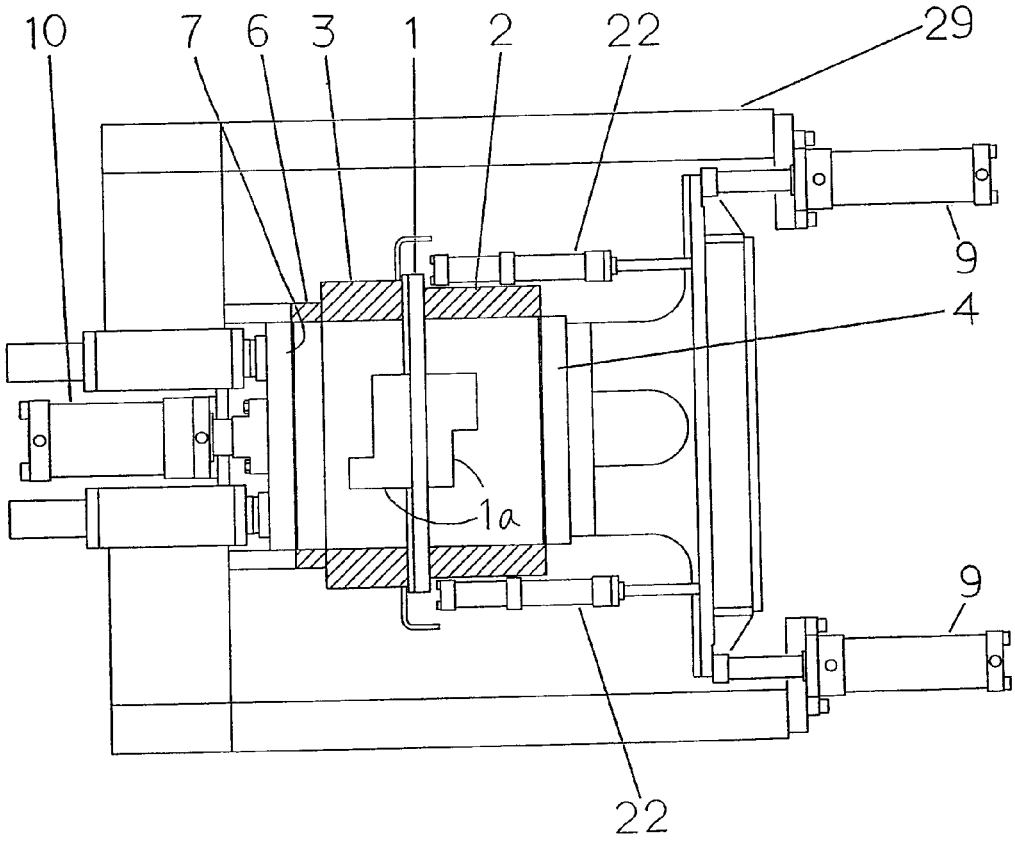
FIG. 3 is a partial plan view of the molding machine in FIG. 2 showing a pair of molding spaces formed therein and their associated elements.
Figure 4:
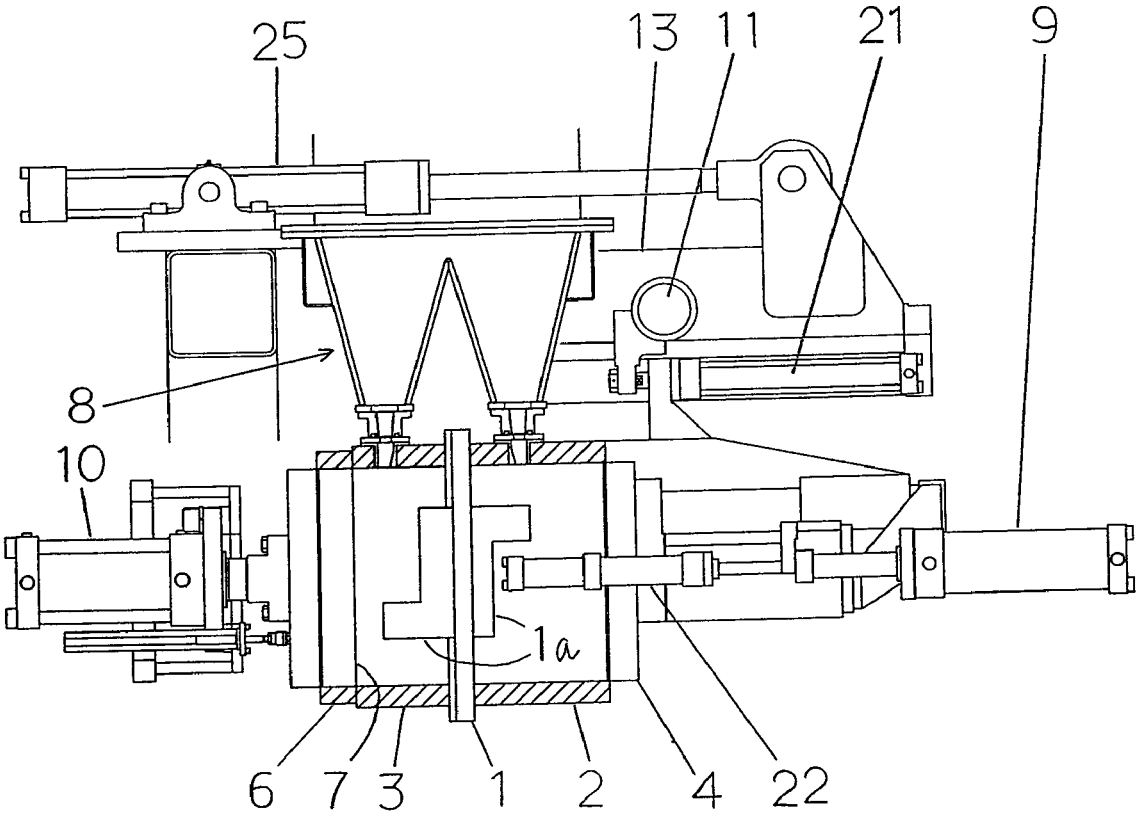
FIG. 4 is a partial side view of the molding machine in FIG. 2 showing a pair of molding spaces formed therein and their associated elements, where some parts are shown in their cross sections.

The plan view in FIG. 3 and the side view in FIG. 4 illustrate the match plate 1, the upper and lower flasks 2 and 3, the upper and lower squeezing members 4 and 7, and the auxiliary flask 6, after forming the upper and lower molding spaces as described above. They have rotated with their related elements to the position right below the means 8 for introducing molding sand. In FIGS. 3 and 4, a supporting frame 29, of which the cross section has approximately a C-shape (FIG. 3), is attached to the platform 5 (FIGS. 1 and 2) under the means 8 for introducing molding sand (FIG. 4).

As shown in FIG. 3, a vertical auxiliary flask 6 is attached to the inside of the left member of the supporting frame 29 so as to abut the lower flask 3 when forming the lower molding space. The single second cylinder 10 is attached to the center of the left member of the supporting frame 29. It points to the right. The vertical lower squeezing member 7 is fixed to the tip of the piston rod of the second cylinder 10. The first cylinders 9 are attached to respective opening ends of the C-shape of the supporting frame 29. They point leftward.

Figure 6:
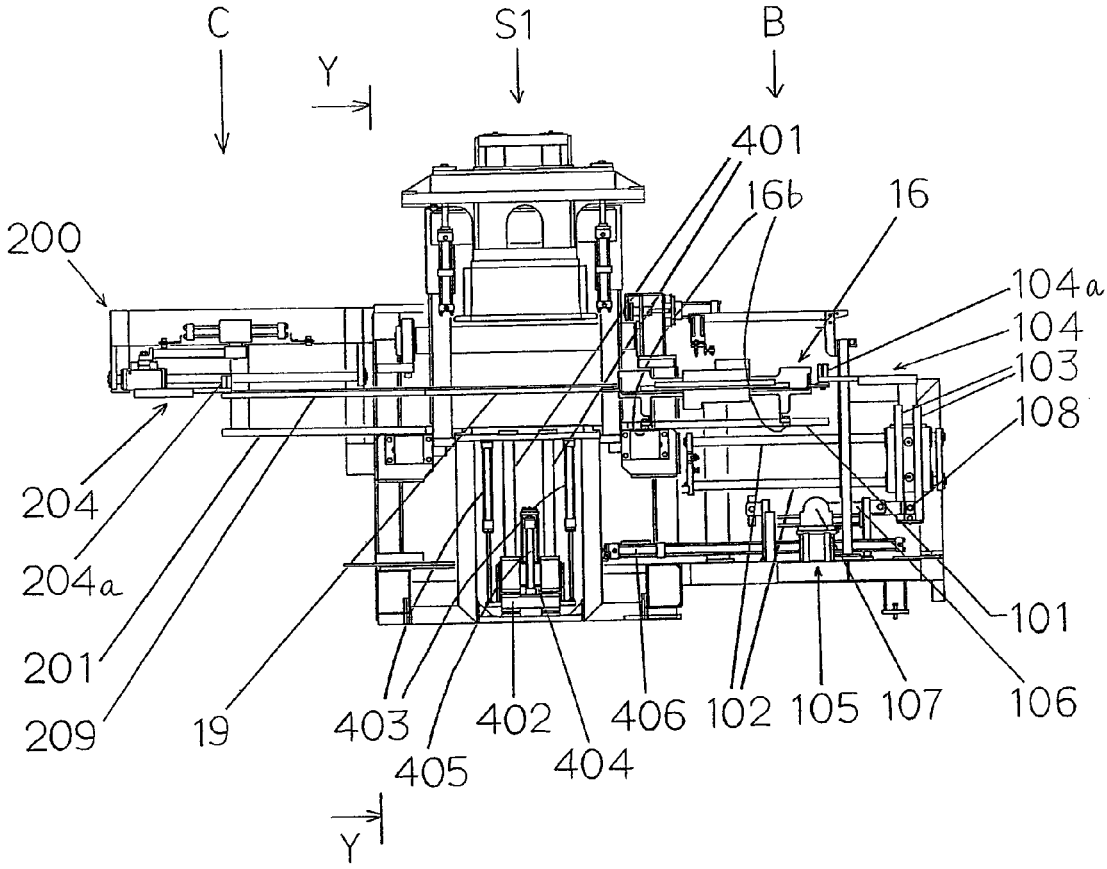
FIG. 6 is a front view of an embodiment of the molding machine of the present invention.

Now, a mold-stripping means D is described. It is located at the lower-right position in FIGS. 1 and 2. As shown in FIG. 6, it has a pair of vertical guide rods 401. They are attached to the base of the platform 5 at a predetermined distance in the longitudinal direction of the molding machine (the lateral direction in FIG. 6). An elevating frame 402 is slidably mounted on the pair of vertical guide rods 401. The piston rods of a pair of ninth cylinders 403 are connected to the elevating frame 402 to move it up and down. The ninth cylinders 403 are suspended from the platform 5 and point downward. A receiving member 404 is disposed above the elevating frame 402 of the mold stripping means D to receive the upper and lower molds. They are piled as they are removed from the piled upper flask 2 and the lower flask 3. The receiving member 404 is supported by the tip of the piston rod of a tenth cylinder 405, which is attached to the elevating frame 402 and points upward. Thus, the receiving member 404 with the elevating frame 402 is elevated by the contraction of the ninth cylinders 403, and then elevated by the extension of the tenth cylinder 405. The mold-stripping means D comprises a cylinder 406 for extruding the piled upper and lower molds on the receiving member 404.

Now, a first mechanism for transporting a match plate B and a second mechanism for transporting a match plate C are described. They face each other and are on opposite sides of the molding station S1, which clamps the match plate 1 via the upper flask 2 and the lower flask 3.

As shown in FIG. 6, the first mechanism for transporting the match plate B is located on one of the sides of the molding station S1. It has a rail 101 for leading the mounting member 16 for the match plate 1 to the position between the upper and lower flasks 2 and 3. It further has a pair of horizontal tie bars 102, which are attached at a predetermined distance to the platform 5 under the rail 101 and extend in the longitudinal direction of the molding machine (the lateral direction in FIG. 6). It further has a pair of rails 103, which are slidably mounted on the tie bars 102. It further has a connecting mechanism 104 for detachably connecting the rails 103 and the mounting member 16. It further has a driving mechanism 105 for driving the rail 103 back and forth along the horizontal tie bar 102. The driving mechanism 105 has a rotary actuator 107, which has a swinging arm 106 for swinging in the longitudinal direction of the molding machine in the plane of FIG. 6. The roller 108, which is attached to the tip of the swinging arm 106, is inserted between the pair of rails 103. When the swinging arm 106 is driven by the rotary actuator 107 to swing back-and-forth, the mounting member 16 moves in the longitudinal direction of the molding machine along the rail 101. The roller 108 and the rails 103 may be substituted by sliding members.

The mounting member 16 has side rollers 16*a*, 16*a* (see FIG. 5) and bottom rollers 16*b*, 16*b*. The first mechanism for transporting the match plate B has an anchor rail 109 (see FIG. 5). The side rollers 16*a*, 16*a* are placed on the anchor rail 109 and the bottom rollers 16*b*, 16*b* contact the sides of the rail 101. A cylinder 104*a* is attached to the connecting mechanism 104. The rails 103 and the mounting member 16 are connected by the extension of the cylinder 104*a*.

Figure 5:
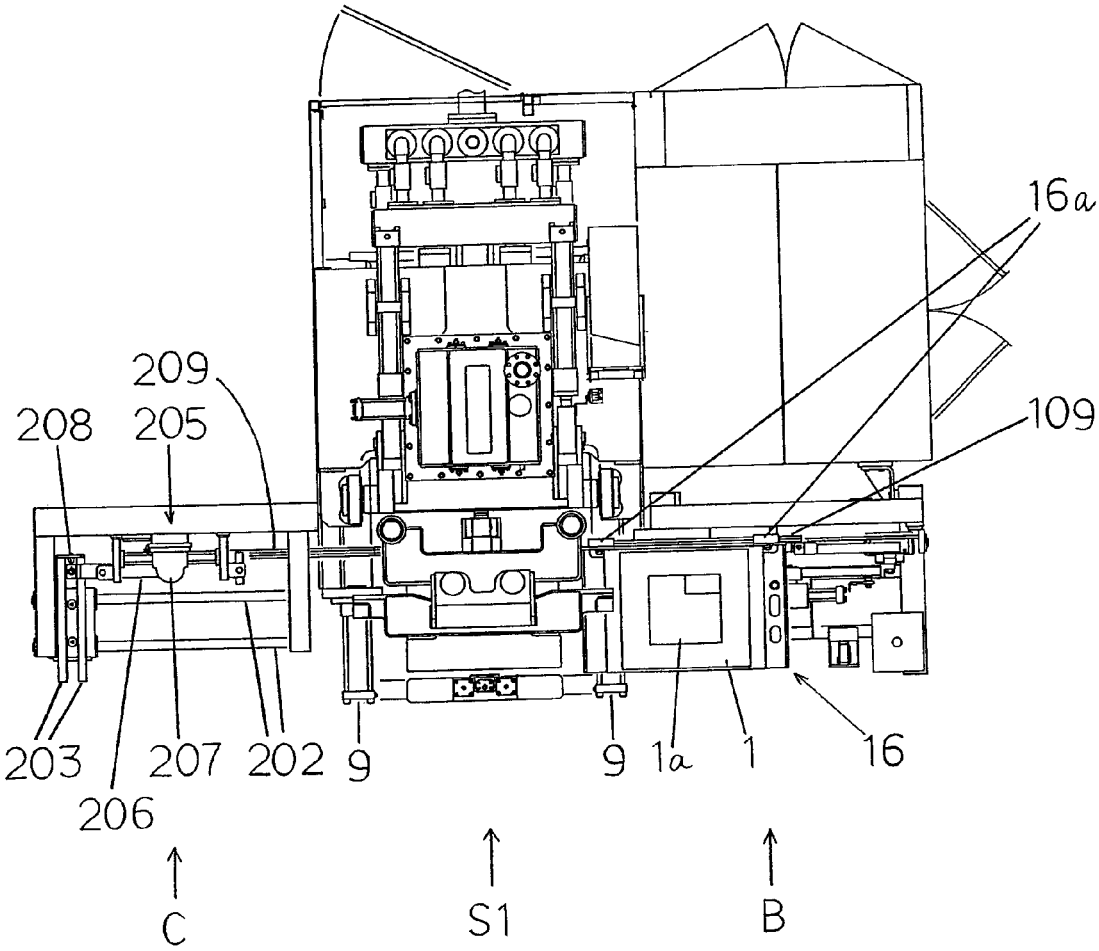
FIG. 5 is a partial plan view of the molding machine in FIG. 6.

As shown in FIG. 5 (a partial plan view of FIG. 6) and FIG. 6, the second mechanism for transporting a match plate C is located on another side of the molding station S1. It has a rail 201 for leading the mounting member 16 for the match plate 1 to the position between the upper flask 2 and the lower flask 3. It further has a pair of tie bars 202 with a predetermined distance between them. They are attached to the frame 200 above the rail 201 and extend in the longitudinal direction of the molding machine (the lateral direction of FIG. 6). It further has a pair of rails 203, which are slidably mounted on the tie bars 202. It further has a connecting mechanism 204 for detachably connecting the rails 203 and the mounting member 16. It further has a driving mechanism 205 for driving the rails 203 back and forth along the horizontal tie bar 202. The driving mechanism 205 has a rotary actuator 207, which has a swinging arm 206 for swinging in the longitudinal direction of the molding machine in the plane of FIG. 5. The roller 208, which is attached to the tip of the swinging arm 206, is inserted between the pair of rails 203. When the swinging arm 206 is driven by the rotary actuator 207 to swing back-and-forth, the mounting member 16 moves in the longitudinal direction of the molding machine along the rail 201. The roller 208 and the rails 203 may be substituted by sliding members.

A cylinder 204*a* is attached to the connecting mechanism 204. To pass the mounting member 16 from the side of the first mechanism for transporting the match plate B to the side of the second mechanism for transporting the match plate C, the rails 203 and the mounting member 16 are connected by the extension of the cylinder 204*a*, as described below. The second mechanism for transporting the match plate C has an anchor rail 209. When the mounting member 16 is at the side of it, the side rollers 16*a*, 16*a* are placed on the anchor rail 209 and the bottom rollers 16*b*, 16*b* contact the sides of the rail 201.

Figure 9:
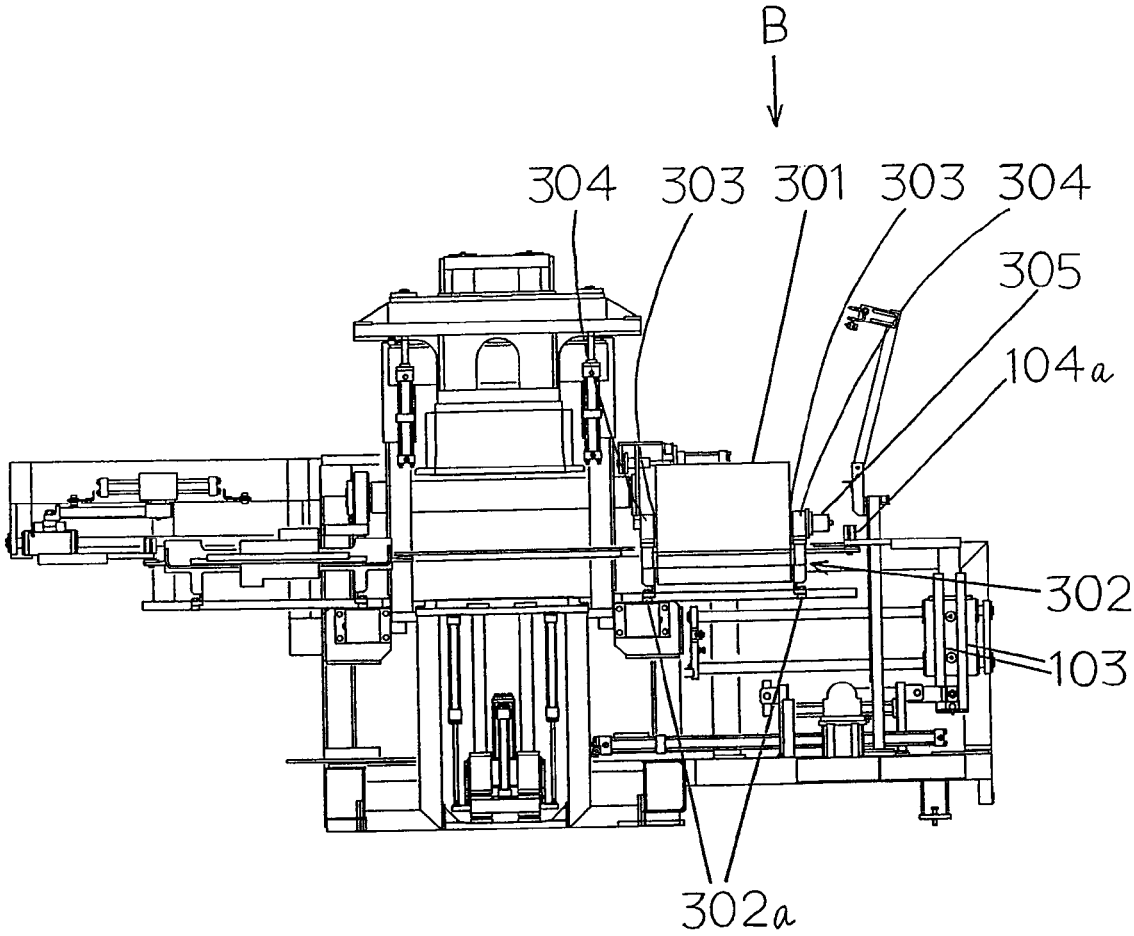
FIG. 9 is a front view of the molding machine in which the jig for a core and the carriage for the core are mounted on the first mechanism for transporting a match plate.

As shown in FIG. 9, in the present invention one of the mechanisms for transporting a match plate (the first mechanism for transporting the match plate B in this embodiment) located at each side of the molding station S1 transports a jig for a core 301 and a carriage for a core 302 to and from the position above the lower mold.

In FIG. 9, the jig for the core 301 has a rotary shaft 303, and can be rotated by it. The shaft 303 is rotatably supported by the carriage for the core 302 by means of bearings 304, 304. It is rotated by a rotary actuator 305 acting as a driving means.

In the jig for the core 301, the part that is contacted by the core is made of resin and is replaceable (not shown). The jig for the core 301 has means for holding a core (not shown). In this embodiment, the means for holding the core is a suctioning means. It need not be a suctioning means. For example, it may be a clamping means for mechanically clamping the core.

The carriage for the core 302, like the mounting member 16, has side rollers (not shown) and bottom rollers 302*a*, 302*a*. When the mounting member 16 is passed to the side of the second mechanism for transporting the match plate C, the carriage for the core 302 is placed on the first mechanism for transporting the match plate B as shown in FIG. 9. When placed as above, the side rollers are placed on the anchor rail 109 and the bottom rollers contact the sides of the rail 101. The carriage for the core 302 is connected to the rails 103 by the extension of the cylinder 104*a*.

Now, the operation of the abovementioned configuration is described. First, the step of preparing the jig for the core 301 and the carriage for the core 302 is described. FIG. 6 illustrates the state where the match plate 1 and the mounting member 16 are at the side of the first mechanism for transporting the match plate B and the rails 103 and the mounting member 16 are connected by the extension of the cylinder 104*a*. At this moment, the connecting mechanism 204 is located at the back end of the second mechanism for transporting the match plate C.

Figure 7:
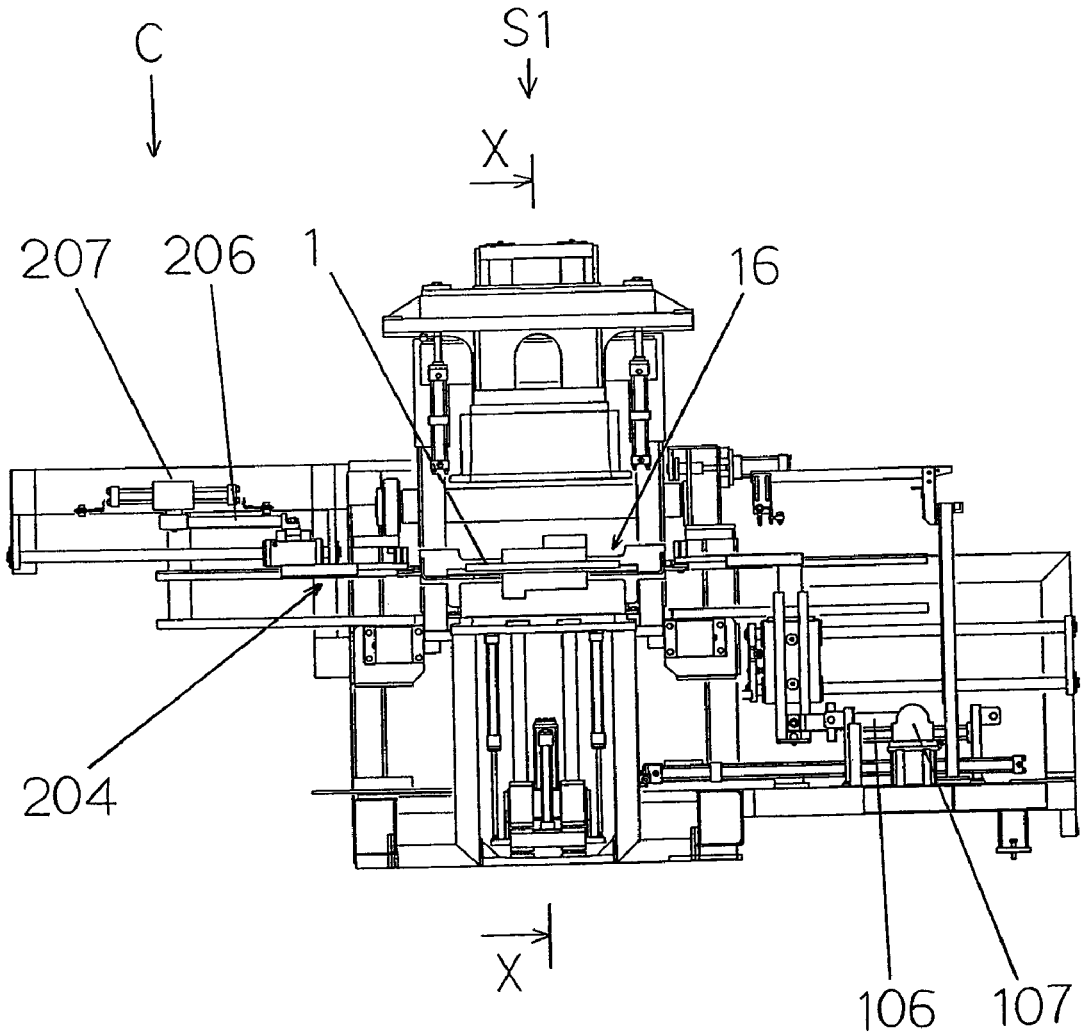
FIG. 7 is a front view of the molding machine wherein the match plate and the mounting member are transported to the molding station that clamps the match plate by the upper flask and the lower flask and the second mechanism for transporting a match plate is moved to the front end of the connecting mechanism.

At this state, the normal movement of the rotary actuator 107 causes the swinging arm 106 to swing in the normal direction (the counterclockwise direction in FIG. 6) to transport the match plate 1 and mounting member 16 to the molding station S1. Then, the normal movement of the rotary actuator 207 causes the swinging arm 206 to swing in the normal direction (the counterclockwise direction in FIG. 5) to transport the connecting mechanism 204 of the second mechanism for transporting the match plate C to the front end, as shown in FIG. 7.

Then, the cylinder 204*a* is extended and the cylinder 104*a* is contracted. By these operations, the mounting member 16 is connected to the rails 203 of the second mechanism for transporting the match plate C and the connection of the mounting member 16 to the first mechanism for transporting the match plate B is released.

Figure 8:
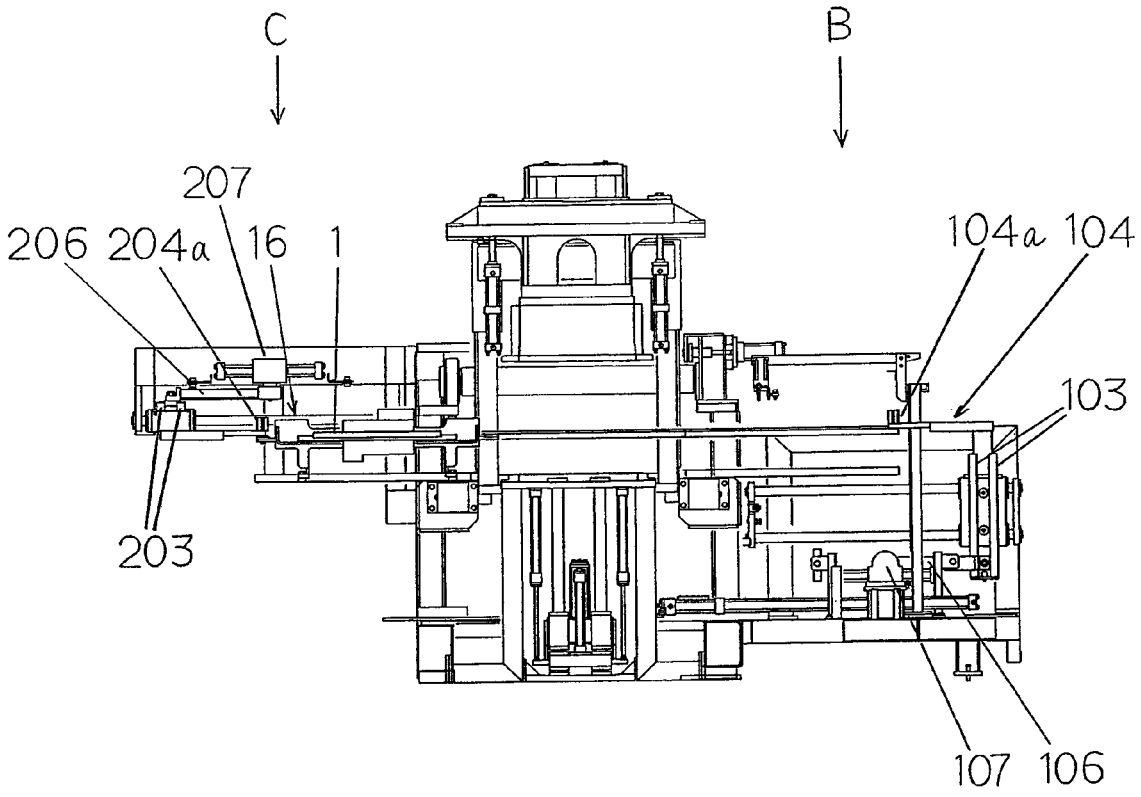
FIG. 8 is a front view of the molding machine in which the match plate and the mounting member are passed to the side of the second mechanism for transporting a match plate.

Then, the reverse movement of the rotary actuator 207 causes the swinging arm 206 to swing in the reverse direction (the clockwise direction in FIG. 5) to pass the match plate 1 and the mounting member 16 to the side of the second mechanism for transporting the match plate C. The reverse movement of the rotary actuator 107 causes the swinging arm 106 to swing in the reverse direction (the clockwise direction in FIG. 7) to transport the connecting mechanism 104 to the back end of the first mechanism for transporting the match plate B, as shown in FIG. 8.

Then, the jig for the core 301 and the carriage for the core 302 are placed on the first mechanism for transporting the match plate B, which is now empty, by a transporting means such as a hoist or a crane (not shown). Then the cylinder 104*a* is extended to connect the rails 103 of the first mechanism for transporting the match plate B to the carriage for the core 302 as shown in FIG. 9.

Now, the operation after the preparation of the jig for the core 301 and the carriage for the core 302 as described above, is described. First, the normal movement of the rotary actuator 207 causes the swinging arm 206 to swing in the normal direction to transport the match plate 1 and the mounting member 16 to the molding station S1. That is, the match plate 1 with the mounting member 16 is inserted between the upper flask 2 and the lower flask 3 (see FIG. 1).

The fourth cylinder 21 of the body A, which points downward, is contracted from the state shown in FIG. 1. The match plate 1 and the upper flask 2, which are in substantially horizontal positions, are piled on the lower flask 3 one by one. Thus, the match plate 1 is clamped between the upper flask 2 and the lower flask 3.

Then, while the first cylinder 9 of the body A remains contracted, the pair of the eighth cylinders 25 of the body A is extended to swing the rotary frame 13 in the clockwise direction about the rotary shaft 11. Thus, the upper flask 2 and the lower flask 3, which clamp the match plate 1, and the upper squeezing member 4, are transported to the position between the first cylinder 9 and the auxiliary flask 6 and are set in their vertical positions. During this operation, the second cylinder 10 is extended by a predetermined length and the pair of the fifth cylinders 25 are contracted. Thus, the formation of the upper and lower molding spaces in FIG. 3 is started. More specifically, while the upper and lower flasks 2 and 3 clamp the match plate 1, the upper squeezing member 4, which opposes the match plate 1, is inserted into the upper flask 2 to form the upper molding space. Since the flasks 2 and 3 clamping the match plate 1, the upper squeezing member 4, and the fifth cylinder 22 for driving the squeezing member 4, integrally swing, the upper molding space can be formed during their swinging. While they swing, the second cylinder 10 is extended to insert the lower squeezing member 7 into the auxiliary flask 6 and into the lower flask 3, which is set in the substantially vertical position by swinging. When the lower flask 3 abuts the auxiliary flask 6 after the swinging, the lower molding space is formed.

Next, compressed air from a supply source (not shown) is supplied to the injecting mechanism 28 of the sand tank 27 to fill the upper and lower molding spaces with molding sand by using the air. It is preferable in this filling to supply the compressed air to the sand tank 27 to shorten the time for introducing molding sand. However, this does not limit the present invention.

Then, the first cylinder 9 and the second cylinder 10 are extended to move the upper squeezing member 4 and the lower squeezing member 7 toward the match plate 1, respectively. Thus, the molding sand in the molding spaces is squeezed. By squeezing as mentioned above, an upper mold and a lower mold are formed in the upper and lower molding spaces, respectively.

Then, the eighth cylinder 25 is contracted to swing the rotary frame 13 in the counterclockwise direction. Thus, the upper flask 2 and the lower flask 3, which contain the upper mold and the lower mold, respectively, are transported.

Then, the fourth cylinder 21 is extended to elevate the upper flask 2. The sixth cylinder 23 is extended to push the match plate 1 away from the upper flask 2. At the same time, the seventh cylinder 24 is extended to push the match plate 1 away from the lower flask 3.

Then, the reverse movement of the rotary actuator 207 causes the swinging arm 206 to swing in the reverse direction to transport the match plate 1 and the mounting member 16 to the side of the second mechanism for transporting the match plate C. That is, the match plate 1 with the mounting member 16 is carried out from the position between the upper flask 2 and the lower flask 3. After they are positioned as shown in FIG. 2, the core-setting is started.

Figure 10:
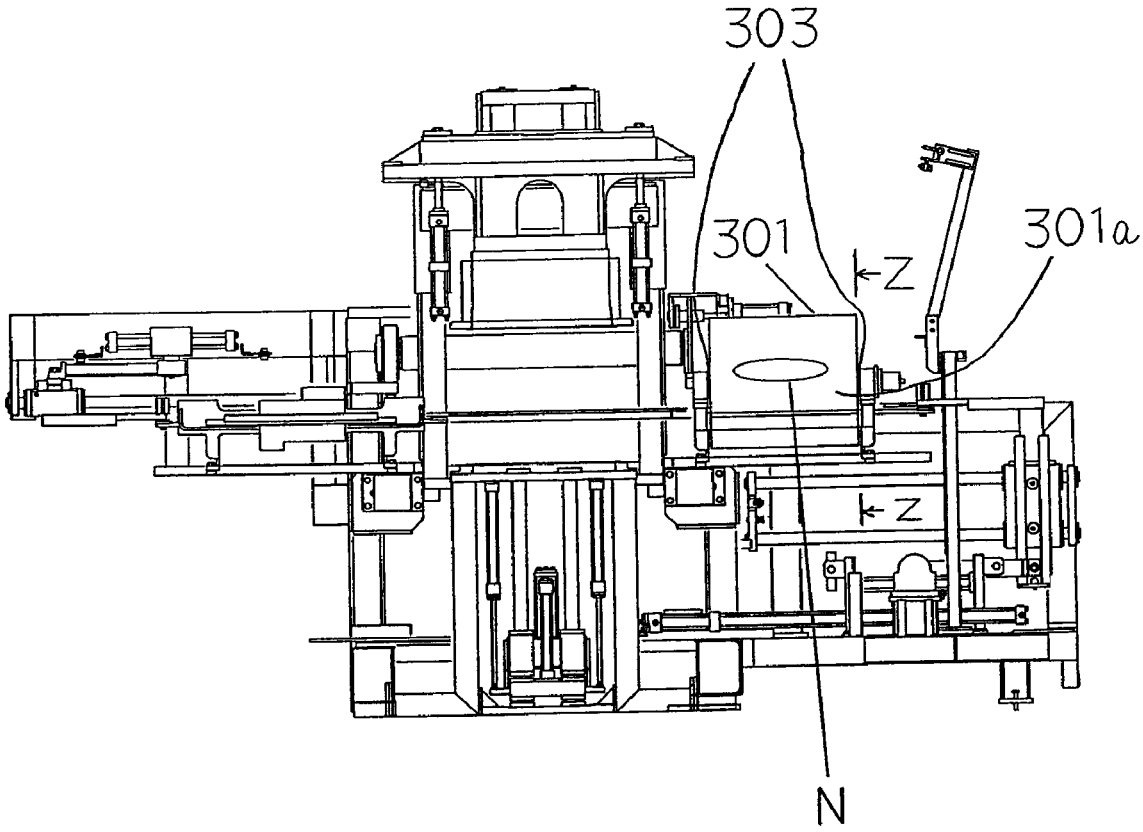
FIG. 10 is a front view of the molding machine in which the jig for the core, which is in its initial position, holds the core.

Now, the core-setting is described. The jig for the core 301 is inclined to the back side (to the side of the body A) at a predetermined angle (30° in this embodiment) from the vertical position about the rotary shaft 303. This is the initial position of it. The core N is manually placed on the holding plane 301*a*, or placed by any other method. The core N is held on the jig for a core by using the suctioning means (see FIGS. 10 and 16). The jig for the core 301 is inclined at a predetermined angle to ease the placement of the core.

Figure 11:
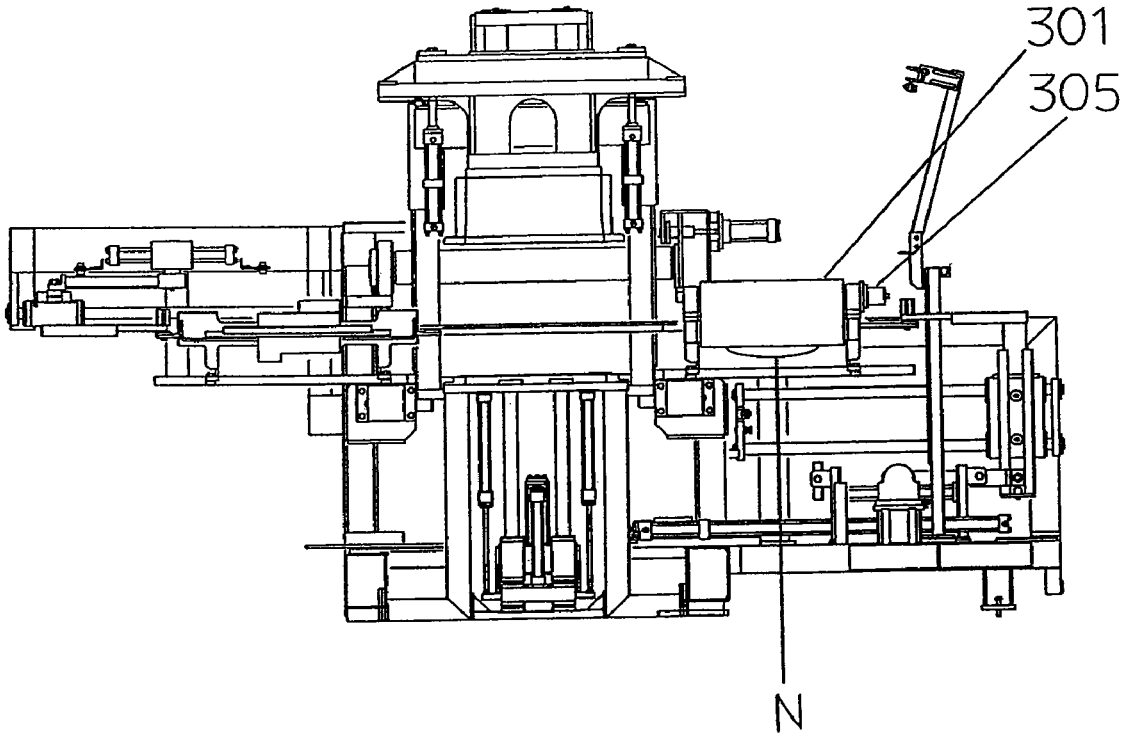
FIG. 11 is a front view of the molding machine in which the jig for the core is rotated by 120° to have the core face downward.
Figure 16:
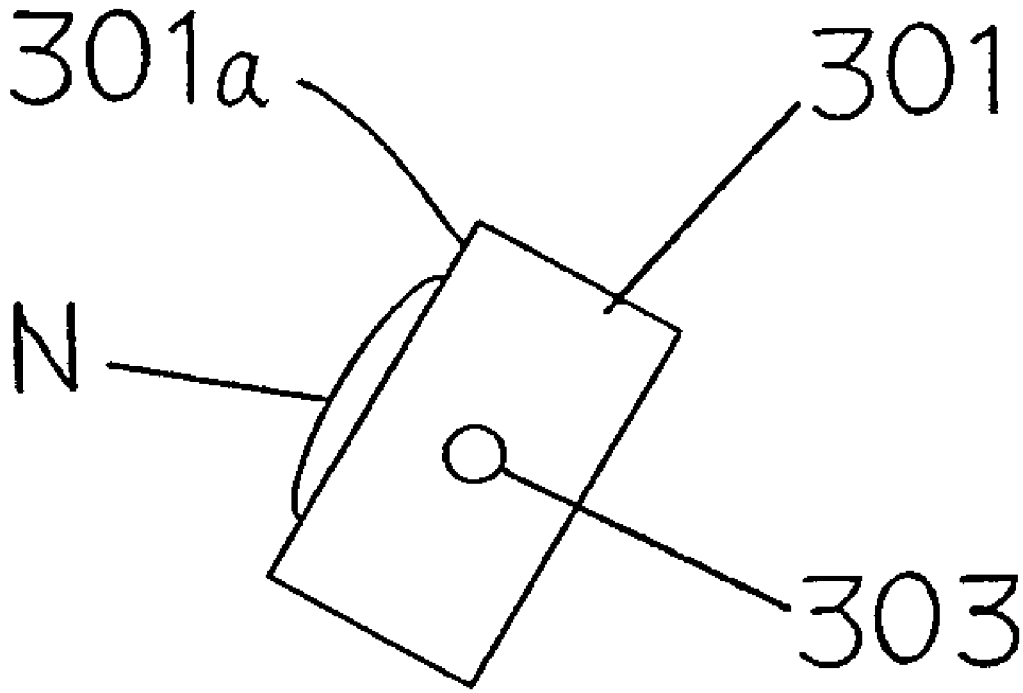
FIG. 16 shows the molding machine as seen from the arrows Z-Z in FIG. 10, illustrating the side view of the jig for the core and its rotary shaft.

Then, the rotary actuator 305 is activated in the normal direction to swing the jig for the core 301 in the normal direction (the counterclockwise direction in FIG. 16). It swings by 120° to place the core N in the position to face downward (see FIG. 11). These operations may be done concurrently with the abovementioned operations of the body A, the second mechanism for transporting the match plate C, the mold stripping means D, etc.

Figure 12:
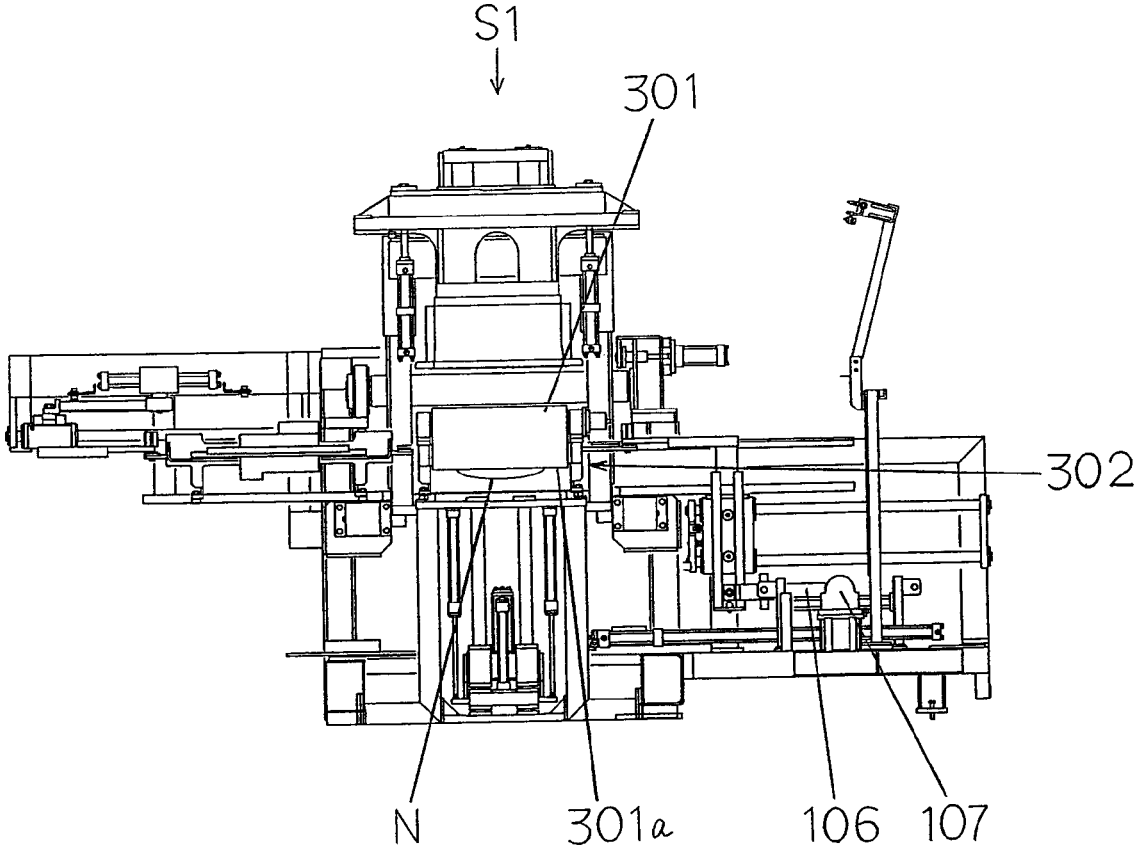
FIG. 12 is a front view of the molding machine in which the carriage for the core is transported to a position above the lower mold and the core faces it.

Then, the normal movement of the rotary actuator 107 causes the swinging arm 106 to swing in the normal direction to transport the jig for the core 301 and the carriage for the core 302 to the molding station S1. Thus, the holding plane 301*a* of the jig for the core 301 faces downward while the carriage for the core 302 is above the lower mold. As a result, the core N, held by the jig for the core 301, faces the lower mold (see FIG. 12).

Figure 13:
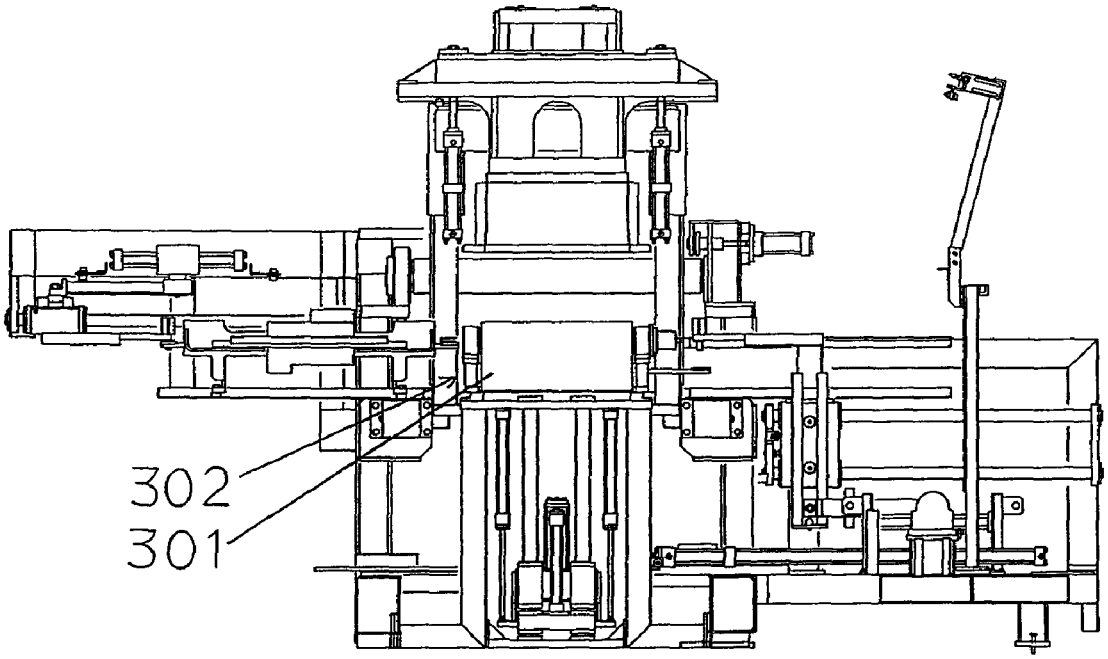
FIG. 13 is a front view of the molding machine in which the core is lowered to nearly abut the lower mold.

Then the elevating actuator, which is attached to the body A and elevates the match plate 1 held between the upper flask 2 and the lower flask 3, is activated in the normal direction. That is, the third cylinder 20 is extended. Thus, the guide rail 19 is lowered. By doing so, the core N, which is held by the jig for the core 301 by means of the carriage for the core 302, is lowered to a position nearly abutting the lower mold (the clearance between the core N and the lower mold is 1 mm in this embodiment) (see FIG. 13). After that, the operation of the suctioning means is stopped to release the core N from the jig for the core 301 while the core N is lowered. As a result, the core N is set on the lower mold.

Figure 14:
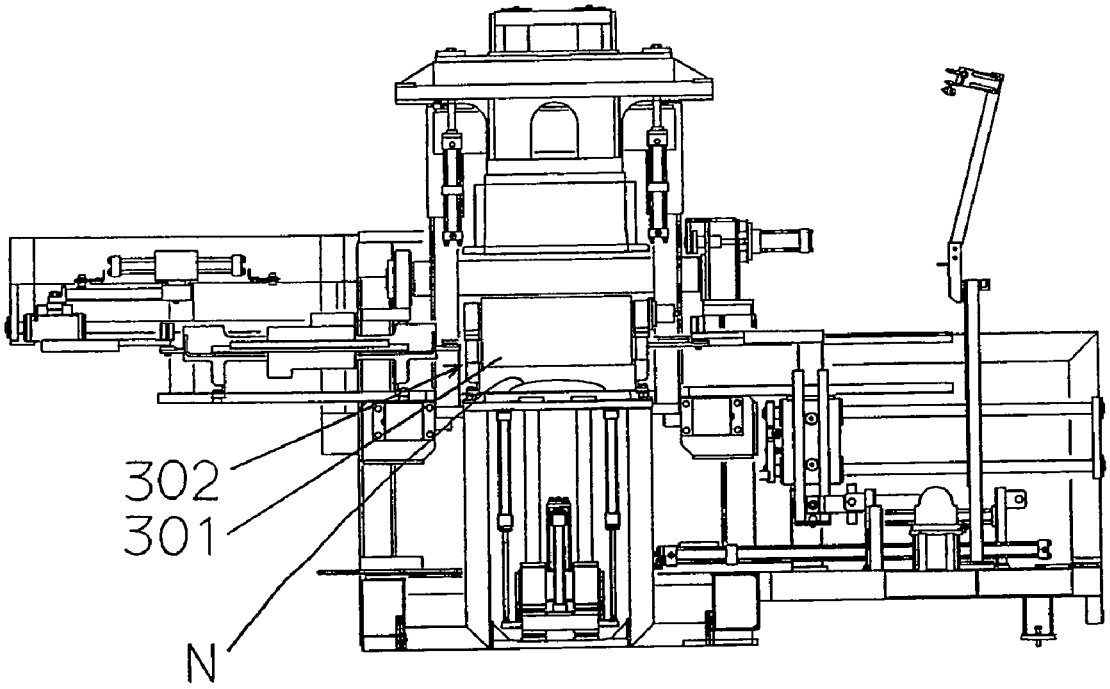
FIG. 14 is a front view of the molding machine in which the carriage for the core and the empty jig for the core are elevated.

Then the elevating actuator is operated in the reverse direction. That is, the third cylinder 20 is contracted. Thus, the guide rail 19 is elevated to elevate both the carriage for the core 302 and the empty jig for the core 301 (see FIG. 14).

Figure 15:
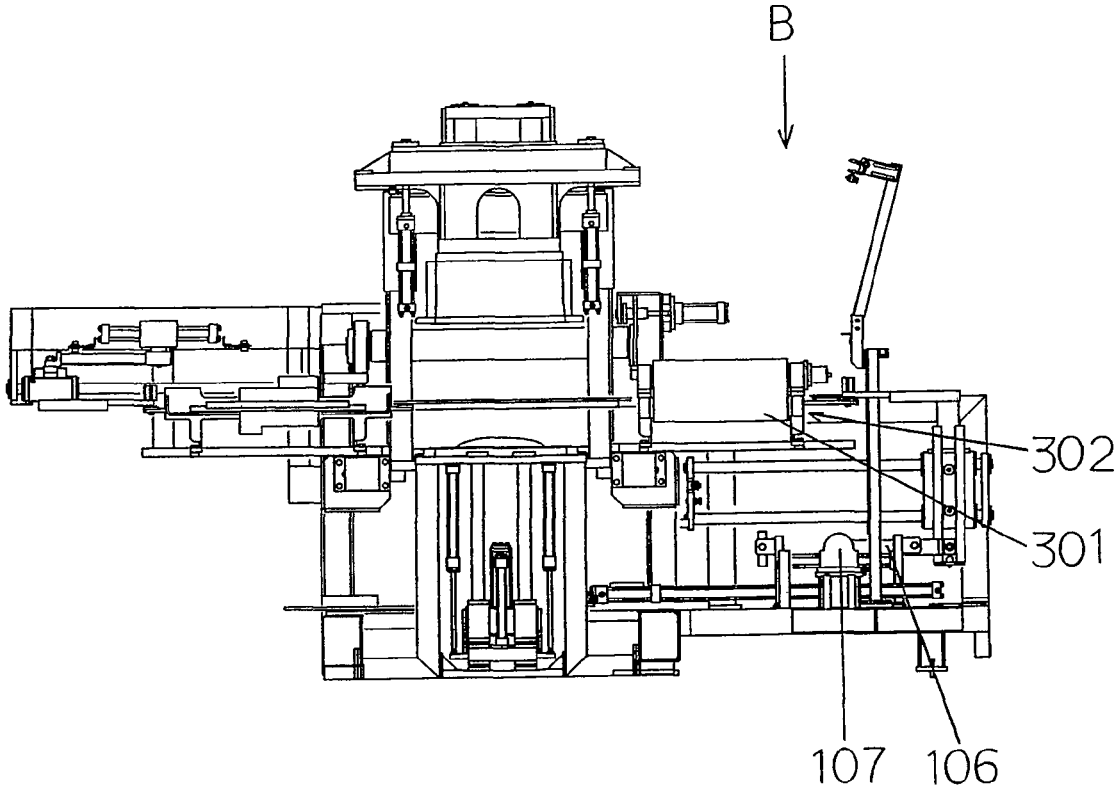
FIG. 15 is a front view of the molding machine in which the jig for the core and the carriage for the core are transported away from a position above the lower mold.

Then, the reverse movement of the rotary actuator 107 causes the swinging arm 106 to swing in the reverse direction to transport the jig for the core 301 and the carriage for the core 302 to the side of the first mechanism for transporting the match plate B. Thus the jig for the core 301 and the carriage for the core 302 are carried out from the position above the lower mold (see FIG. 15). The rotary actuator 305 is operated in the reverse direction to swing the jig for the core 301 in the reverse direction (the clockwise direction in FIG. 16) by 120°. Thus, the jig for the core 301 returns to its initial position while the carriage for the core 302 is not in the position above the lower mold (see FIG. 9).

In the molding station S1, the ninth cylinder 403 of the mold-stripping means D is contracted to elevate the elevating frame 402, tenth cylinder 405, etc. Then, the fourth cylinder 21 is contracted to lower the upper flask 2 to pile it on the lower flask 3. The tenth cylinder 405 of the mold-stripping means D is extended to elevate the receiving member 404 to have it abut the bottom of the lower mold. Then, the fifth cylinder 22 is contracted to press the upper mold in the upper flask 2 downward by means of the upper squeezing member 4. At the same time, the tenth cylinder 405 is contracted. Then, the ninth cylinder 403 is extended to lower the receiving member 404. Thus, the upper and lower molds are taken out of the upper flask 2 and the lower flask 3. Then the fifth cylinder 22 is extended to elevate the upper squeezing member 4. Then, the extruding cylinder 406 is extended to push the piled upper and lower molds out of the receiving member 404. Thus, piled flaskless upper and lower molds are obtained.

Unlike the above embodiment, when molds are formed without a core, that is, when the core-setting is unnecessary, the match plate 1 and the mounting member 16 are transported to and from the molding station S1 by the first mechanism for transporting the match plate B, not by the second mechanism for transporting the match plate C. In such a case, the jig for the core 301 and the carriage for the core 302 are not placed on the first mechanism for transporting the match plate B.

By the present invention, the degree of the accuracy in the core-setting is kept higher because the core N is set within the body A of the molding machine, which is rigid and has a high accuracy. The jig for the core 301 is just transported to a position near the match plate 1 and between the upper flask 2 and the lower flask 3 in the body A so that the core N faces downward. In a conventional molding machine, the core-setting is performed such that the lower flask is carried out of the molding machine, that is, it is elevated on a cantilever. Thus, the accuracy deteriorates. In addition, by the present invention, the configuration of the molding machine is simplified, because the core-setting is performed within the body A of the molding machine, and so no means for transporting the lower flask longitudinally is required.

In the molding machine of the present invention, the elevating actuator, namely, the third cylinder 20, is attached to the body A and elevates the match plate 1 between the upper flask 2 and the lower flask 3. It also elevates the jig for the core 301 and the carriage for the core 302, which are transported to the position between the upper flask 2 and the lower flask 3. Thus, advantageous effects, such as reducing the number of actuators and making a smaller machine, are obtained.

Furthermore, in the molding machine of the present invention, the mechanisms for transporting the match plate are disposed at their respective side of the molding station S1, where the match plate 1 is clamped between the upper flask 2 and the lower flask 3. That is, the first mechanism for transporting the match plate B and the second mechanism for transporting the match plate C face each other at the sides. One of the mechanisms for transporting a match plate (the first mechanisms for transporting the match plate B in this embodiment) is configured to transport the jig for the core 301 and the carriage for the core 302 to and from the position above the lower mold. Thus, the core N can be manually placed on the holding plane 301*a* of the jig for the core 301 in its initial state and be held on the jig for the core 301 by operating the suctioning means concurrently with the operation of the body A, the second mechanism for transporting the match plate C, the mold stripping means D, etc, when the jig for the core 301 and the carriage for the core 302 are located at the side of the first mechanism for transporting the match plate B by being transported away from the position between the upper flask 2 and the lower flask 3 and neither the jig for the core 301 nor the carriage for the core 302 is operated. As a result, the efficiency of the operation can be enhanced.

In the embodiment, the core N, which is held by the jig for the core 301 by means of the carriage for the core 302, is lowered to the position nearly abutting the lower mold. However, this does not limit the scope of the invention. The core N may be lowered to abut the lower mold.

In the embodiment, the core N, which is held by the jig for the core 301 by means of the carriage for the core 302, is lowered to a position nearly or actually abutting the lower mold. Then the operation of the suctioning means is stopped, to release the core N from the jig for the core 301 while the core N is lowered. Thus, the core N is set on the lower mold. However, this does not limit the scope of the invention. It is preferable to set the core N on the lower mold by pressuring it with compressed air after stopping the operation of the suctioning means, because by doing so any fault in releasing the core N is prevented. Thus the certainty of releasing the core N increases. To press the core N with compressed air, the suction and compression means may be substituted for the suctioning means as the means for holding a core.

Furthermore, in the embodiment, the jig for the core 301 is rotated by rotating the rotary shaft 303, which is rotated by the rotary actuator 305. This does not limit the scope of the invention. An arm may be connected to an end of the rotary shaft 303. The rotary shaft may be rotated by the arm when a cylinder is extended and contracted. The rotary arm 303 may be rotated by a cam mechanism without an actuator.

Next, another embodiment, which differs from the above embodiment ("the first embodiment"), is described as the second embodiment. Its configuration differs from that of the first embodiment in that a mechanism for transporting the jig for a core E and a mechanism for transferring a core F are disposed instead of the second mechanism for transporting the match plate C. The configurations of the body A of the molding machine, the mold stripping means D, and the first mechanism for transporting the match plate B, are the same as those of the first embodiment. Below the second embodiment is described with reference to the drawings, where the same element as in the first embodiment has the same symbol, and so no explanation is repeated. In the second embodiment, the molding machine has only one mechanism for transporting the match plate B. It is referred to as the mechanism for transporting a match plate G.

Figure 17:
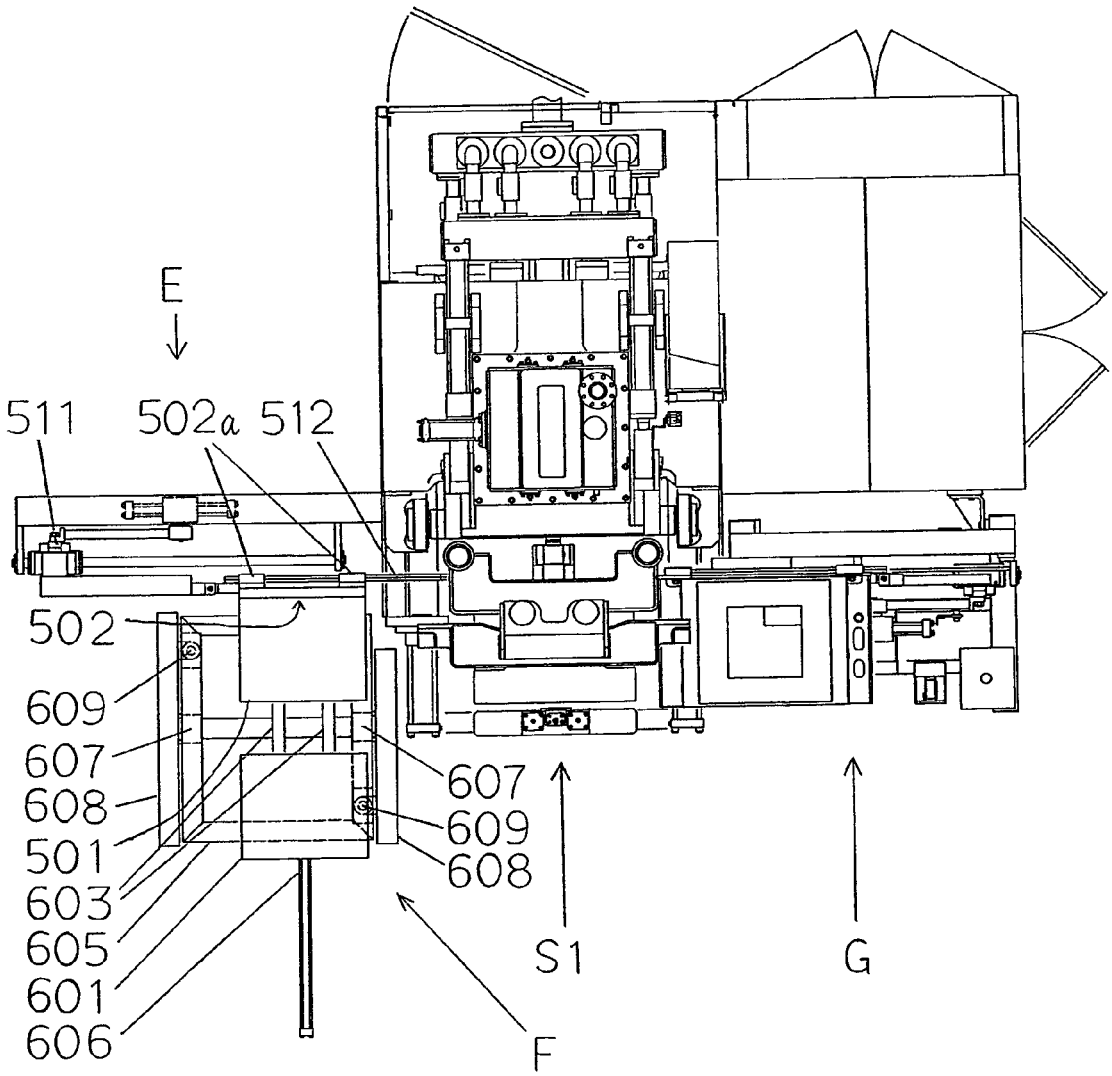
FIG. 17 is a partial view of FIG. 18.

As shown in FIG. 17, the mechanism for transporting a match plate G is disposed at one of the sides of the molding station S1, where the match plate 1 is clamped between the upper flask 2 and the lower flask 3. At another side, the mechanism for transporting the jig for the core E is disposed and faces the mechanism for transporting a match plate G. The mechanism E transports a jig for a core 501 and a carriage for a core 502 to and from the position above the lower mold.

Now, the configuration of the mechanism for transporting the jig for the core E is described. The jig for the core 501 is connected to the carriage for the core 502. Thus, it can be transported to and from the position above the lower mold by means of the carriage for the core 502. In the jig for the core 501, the part that is contacted by the core is made of resin and is replaceable (not shown). The jig for the core 501 has means for holding a core (not shown). In this embodiment, the means for holding a core is a suctioning means. But it is not necessarily a suctioning means, and, for example, may be a clamping means for mechanically clamping the core. The carriage for the core 502 has side rollers 502*a*, 502*a* and bottom rollers 502*b*, 502*b* (see FIG. 19).

Figure 18:
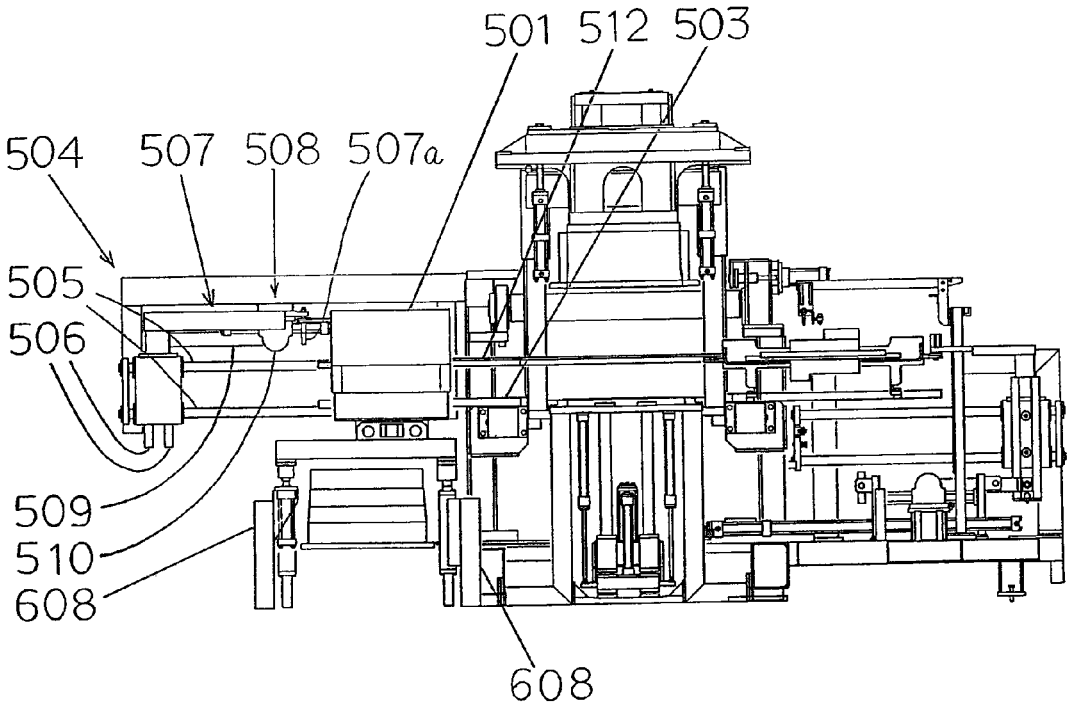
FIG. 18 is a front view of the second embodiment of the present invention.

As shown in FIG. 18, the mechanism for transporting the jig for the core E has a rail 503 to lead the carriage for the core 502 to the position between the upper flask 2 and the lower flask 3. The mechanism E has a pair of horizontal tie bars 505. The tie bars 505 are attached at a vertically predetermined distance to a frame 504. The tie bars 505 extend in the longitudinal direction of the molding machine (the lateral direction in FIG. 18). It further has a pair of rails 506, which are slidably mounted on the pair of horizontal tie bars 505. It further has a connecting mechanism 507 for detachably connecting the rails 506 and the carriage for the core 502. The mechanism E further has a driving mechanism 508 for driving the rails 506 back and forth along the horizontal tie bars 505. The driving mechanism 508 has a rotary actuator 510, which is a driver having a swinging arm 509, which swings in the longitudinal direction of the molding machine in the plane of FIG. 18. A roller 511 (see FIG. 17), which is attached to the tip of the swinging arm 509, is inserted between the pair of rails 506. When the swinging arm 509 swings back and forth by means of the rotary actuator 510, the carriage for the core 502 moves back and forth in the longitudinal direction of the molding machine along the rail 503. The roller 511 and the rails 506 may be replaced by sliding members.

A pin 507*a* is attached to the connecting mechanism 507. The pin 507*a* penetrates a hole (not shown) in the carriage for the core 502. Thus, the rails 506 and the carriage for the core 502 are connected. The mechanism for transporting the jig for the core E comprises an anchor rail 512. When the carriage for the core 502 is positioned at the side of the mechanism for transporting the jig for the core E, the side rollers 502*a*, 502*a* are mounted on the anchor rail 512 and the bottom rollers 502*b*, 502*b* contact the sides of the rail 503.

Figure 19:
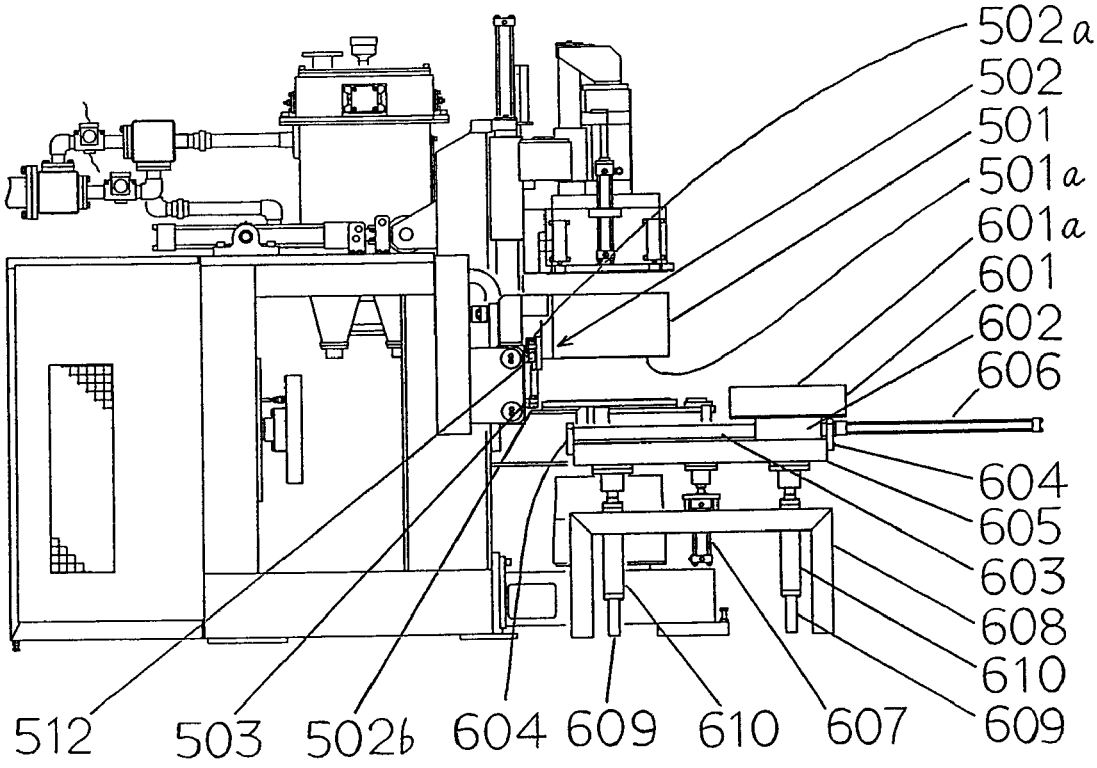
FIG. 19 is a left side view of FIG. 18.

Next, the configuration of the mechanism for transferring a core F, which is located below the mechanism for transporting the jig for the core E, is described. A jig for transporting a core 601 goes to and from the position below the jig for the core 501. As shown in FIG. 19, it is configured to have an upper plane 601*a* on which the core is placed. The core is precisely positioned on the plane 601*a* by a positioning member (not shown) disposed on the plane 601*a*.

A holder 602 is fixed to the lower center of the jig for transporting the core 601. The guide rods 603, 603 are disposed below the jig for transporting the core 601. They are horizontally spaced. They slidably penetrate the holder 602. Both of their ends are supported by supporting plates 604, 604. The respective supporting plates 604, 604 are fixed to each end of the elevating frames 605. The frame 605 is disposed below the guide rods 603, 603. A lateral cylinder 606 is attached to one of the supporting plates 604. The tip of the piston rod of the lateral cylinder 606 is connected to the holder 602.

The respective bottom ends of the elevating frames 605 are connected to the tips of the piston rods of the elevating cylinders 607, 607. The elevating cylinders 607, 607 are attached to the supporting frames 608, 608. The guide rods 609, 609 are suspended from the bottom end of the elevating frame 605. They are located next to the elevating cylinders 607, 607 at opposing corners (see FIG. 17). They slidably penetrate the holders 610, 601, which are fixed to the supporting frames 608, 068.

Next, the operation of the machine having such a configuration is described. The upper and lower molds are formed. Then, they and the match plate 1 are separated. The match plate 1 is carried out of the molding station S1. Thus, their state is as shown in FIGS. 17, 18, and 19. The operations up to this state are the same as those of the first embodiment, and so the description is not repeated.

Figure 20:
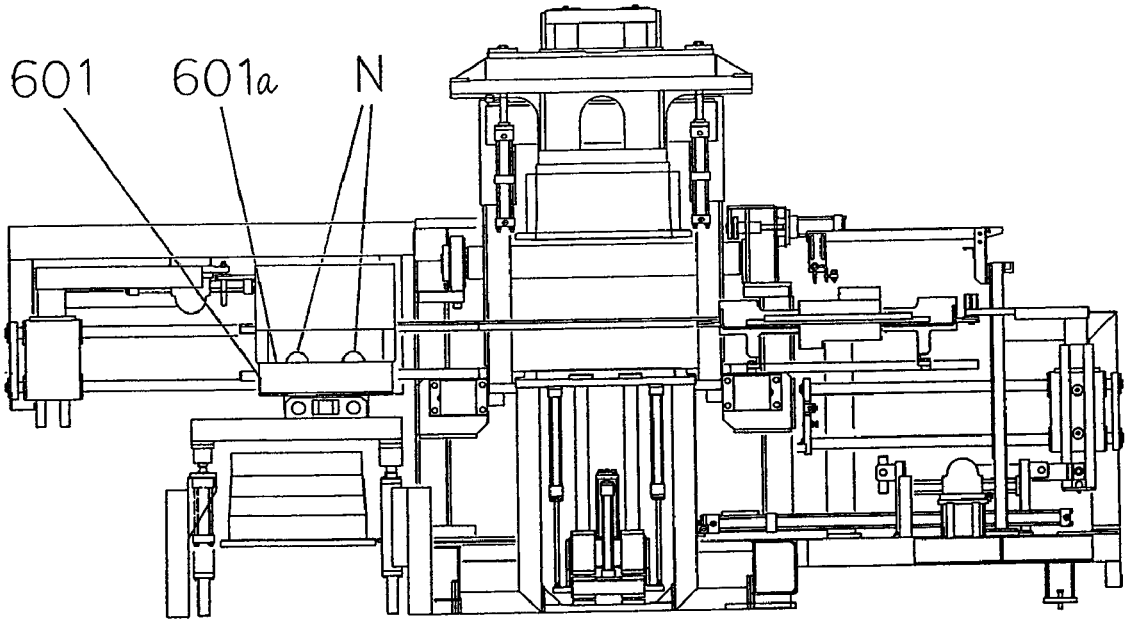
FIG. 20 is a front view of the molding machine in which the core is manually placed on the jig for transporting the core.
Figure 21:
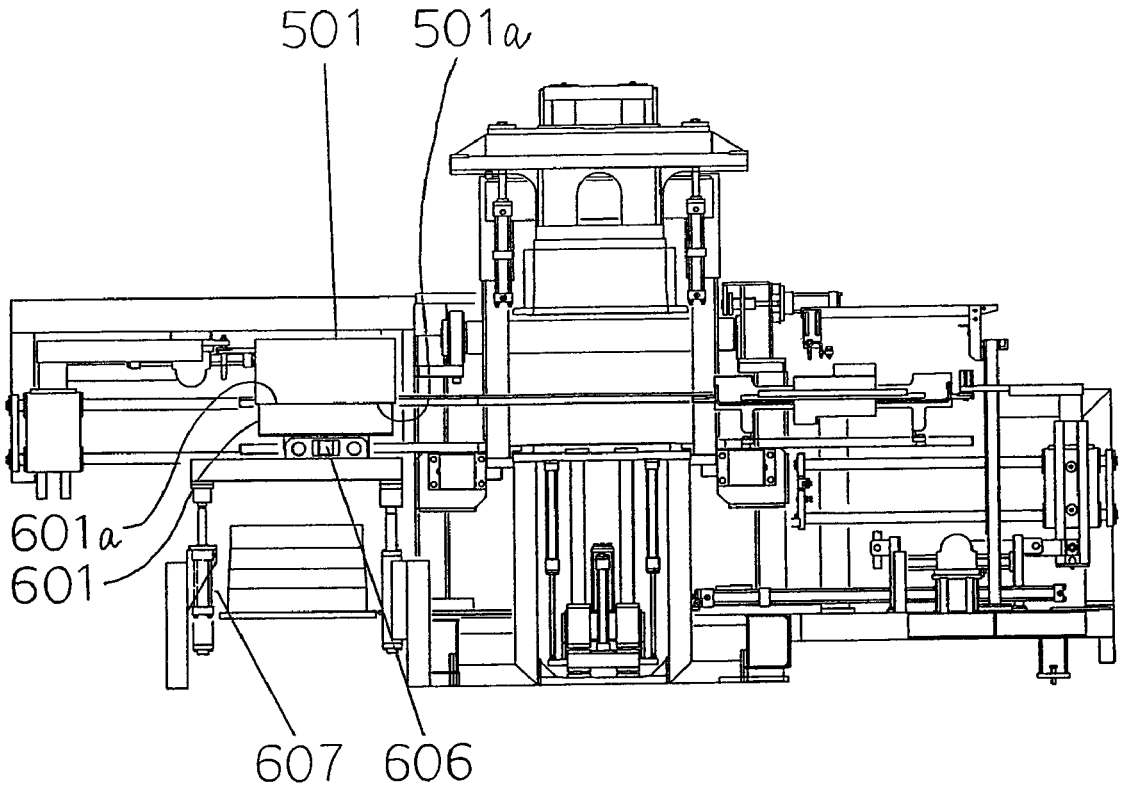
FIG. 21 is a front view of the molding machine in which the jig for transporting the core is elevated to have its upper plane abut the holding plane of the jig for the core.

The core-setting is started in this state. Now, the core-setting is described in detail. First, the core N is manually placed on the upper plane 601*a* of the jig for transporting the core 601 or placed by any other method (see FIG. 20). Then, the lateral cylinder 606 is extended to transport the jig for transporting the core 601 to the position below the jig for the core 501. The elevating cylinders 607, 607 are extended to elevate the jig for transporting the core 601 to the position where the upper plane 601*a* abuts the holding plane 501*a* of the jig for the core 501 (see FIG. 21). At this time, a positioning boss (not shown) on the holding plane 501*a* fits into a positioning hole (not shown) formed from the upper plane 601*a* of the jig for transporting the core 601. Thus, the jig for the core 501 and the jig for transporting the core 601 are well positioned.

Figure 22:
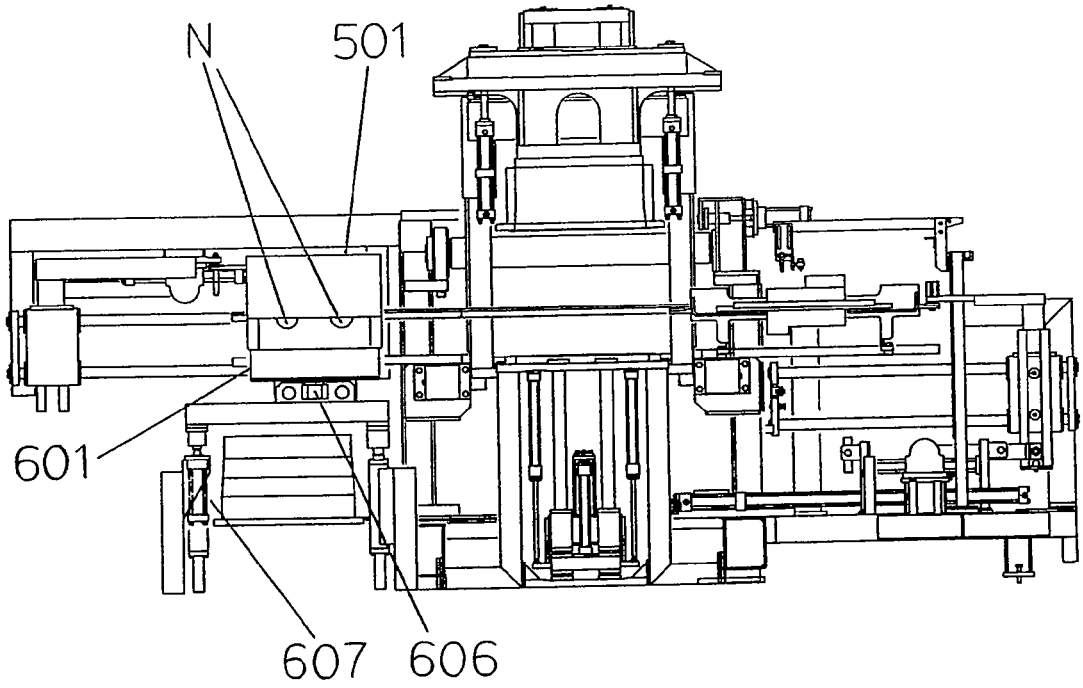
FIG. 22 is a front view of the molding machine in which the jig for transporting the core is lowered after holding the core at the jig for the core by suction.

Then, the suctioning means is activated to hold the core N on the jig for the core 501 by suction. Then, the elevating cylinders 607, 607 are contracted to lower the jig for transporting the core 601 (see FIG. 22). The lateral cylinder 606 is contracted to transport the jig for transporting the core 601 away from the position below the jig for the core 501. These operations may be performed concurrently with the operation of the body A, that of the mechanism for transporting a match plate G, that of the mold-stripping means D, etc.

Figure 23:
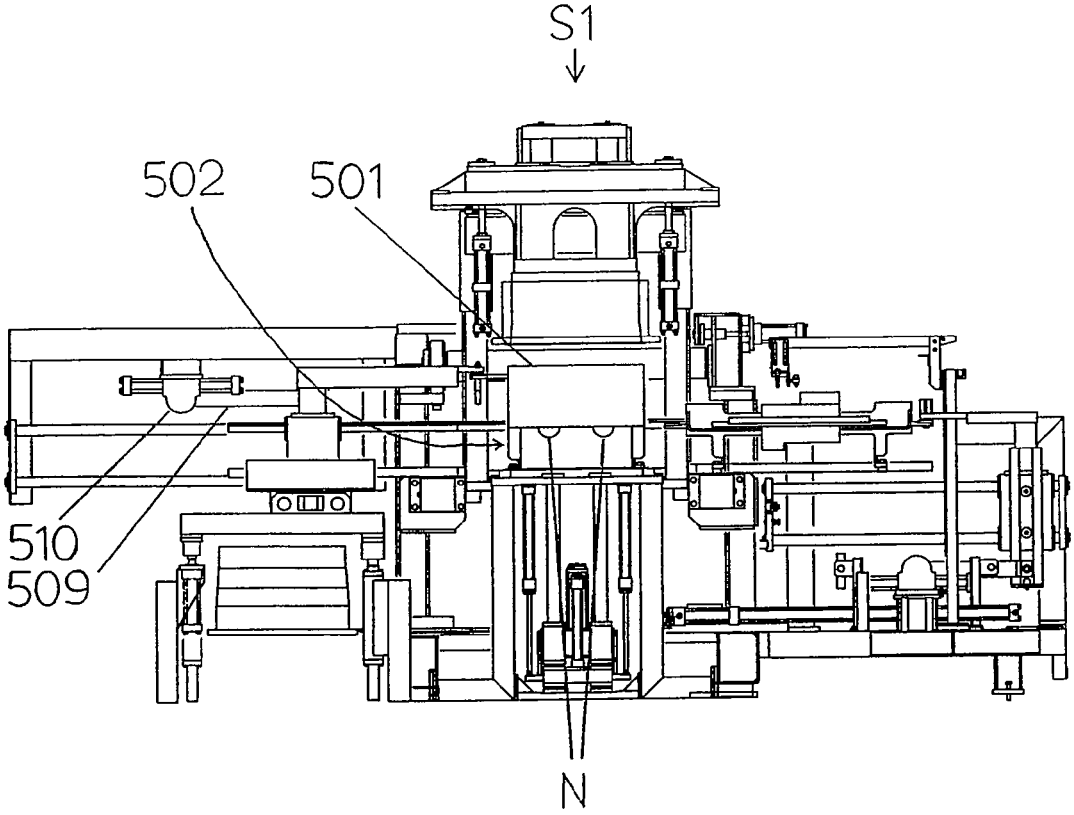
FIG. 23 is a front view of the molding machine in which the carriage for the core is transported to a position above the lower mold and the core faces it.

Then, the normal movement of the rotary actuator 510 causes the swinging arm 509 to swing in the normal direction (the counterclockwise direction in FIG. 23) to transport the jig for the core 501 and the carriage for the core 502 to the side of the molding station S1. Thus, the carriage for the core 502 is transported to the position above the lower mold. The core N, which is held by the jig for the core 501, faces the lower mold (see FIG. 23).

Figure 24:
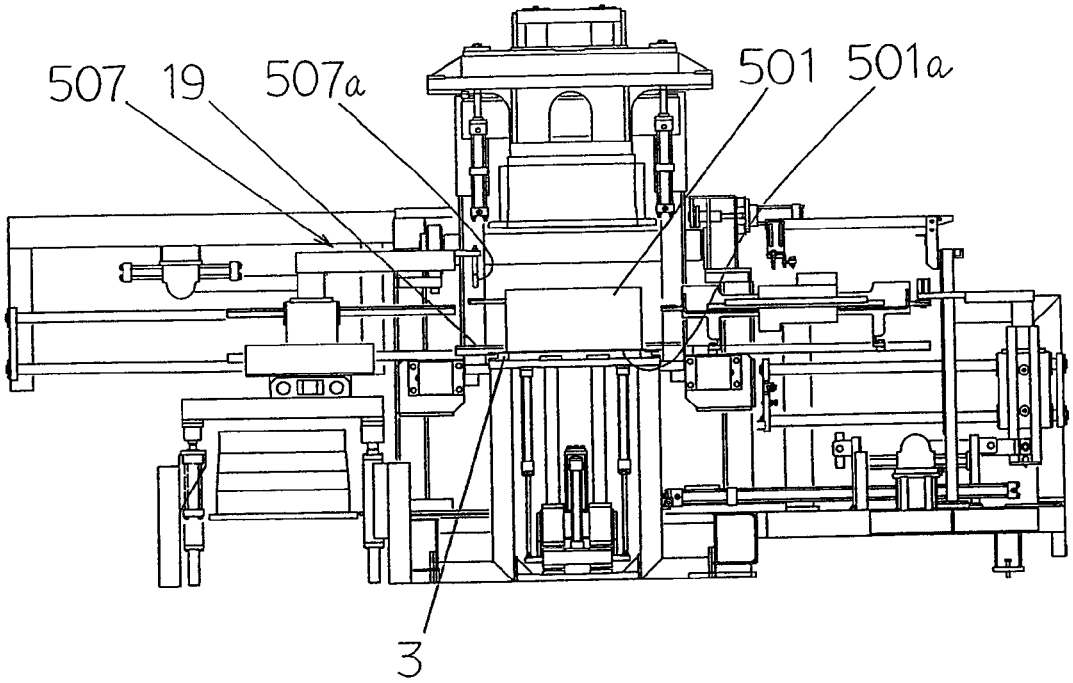
FIG. 24 is a front view of the molding machine in which the core is lowered to nearly abut the lower mold.

Then, the elevating actuator, which is attached to the body A and elevates the match plate 1 located between the upper flask 2 and the lower flask 3, is operated in the normal direction. That is, the third cylinder 20 (see FIG. 1) is extended. Thus, the guide rail 19 is lowered. The core N, which is held by the jig for the core 501 by means of the carriage for the core 502, is lowered to the position nearly abutting the lower mold (in this embodiment, the clearance between the core N and the lower mold is 1 mm) (see FIG. 24). Then, the operation of the suctioning means is stopped to release the core N from the jig for the core 501 while the core N is lowered. Thus, the core N is set on the lower mold. When the carriage for the core 502 is lowered, the pin 507*a* of the connecting mechanism 507 comes out of the hole (not shown) in the carriage for the core 502. However, the positioning boss (not shown) on the holding plane 501*a* of the jig for the core 501 fits into the hole (not shown) formed from the upper plane of the lower flask 3. Thus, the jig for the core 501 and the lower flask 3 are well positioned.

Figure 25:
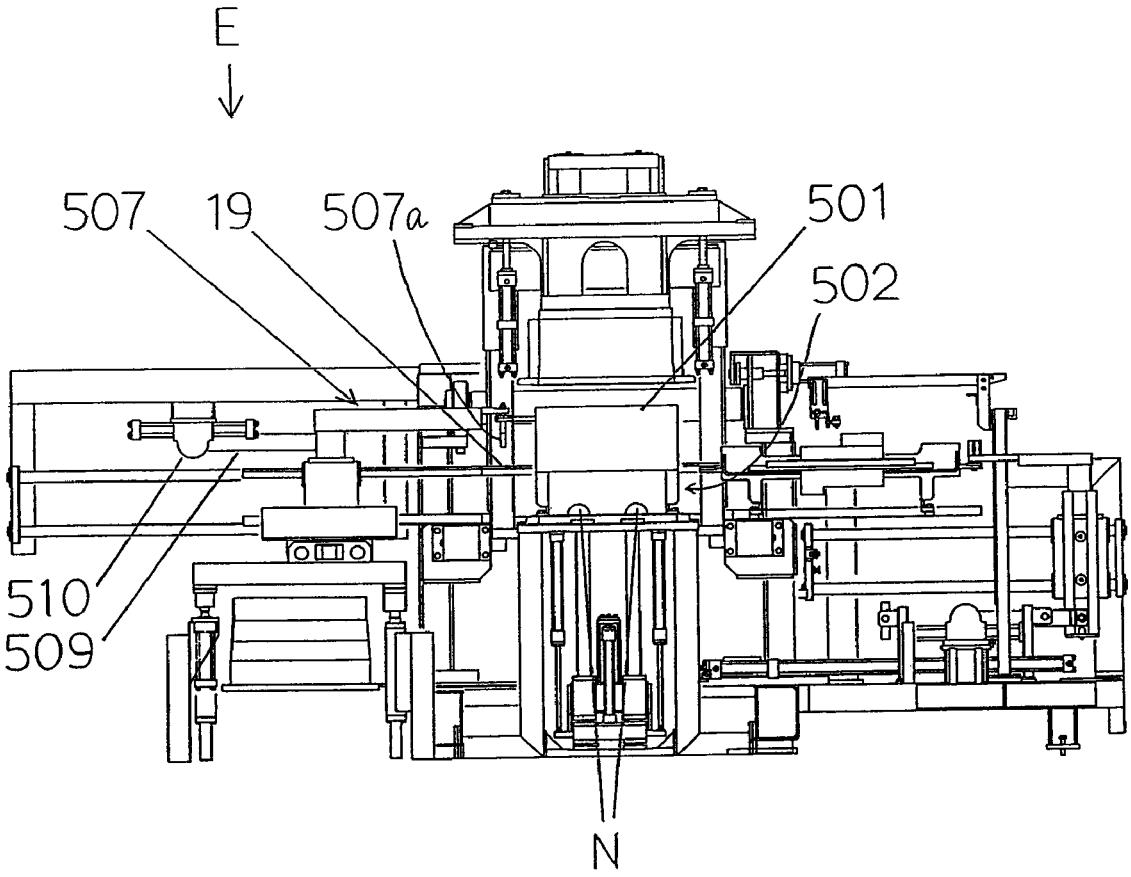
FIG. 25 is a front view of the molding machine in which the carriage for the core and the empty jig for the core are elevated.

Then, the elevating actuator is activated in the reverse direction. That is, the third cylinder 20 is contracted to elevate the guide rail 19. Thus, the carriage for the core 502 and the empty jig for the core 501 are elevated (see FIG. 25). When the carriage for the core 502 is elevated, a pin 507*a*, which is attached to the connecting mechanism 507, penetrates the hole (not shown) in the carriage for the core 502.

Then, the reverse movement of the rotary actuator 510 causes the swinging arm 509 to swing in the reverse direction to transport the jig for the core 501 and the carriage for the core 502 to the side of the mechanism for transporting the jig for the core E. Thus, the jig for the core 501 and the carriage for the core 502 are carried away from the position above the lower mold.

Then, in the molding station S1, the ninth cylinder 403 of the mold-stripping means D is contracted to elevate the elevating frame 402, the tenth cylinder 405, etc. Then, the fourth cylinder 21 is contracted to lower the upper flask 2 so that it is piled on the lower flask 3. The tenth cylinder 405 of the mold stripping means D is contracted to elevate the receiving member 404 so that it abuts the bottom of the lower mold. Following that, the fifth cylinder 22 is contracted to press the upper mold in the upper flask 2 downward by means of the upper squeezing member 4. At the same time, the tenth cylinder 405 is contracted. Then, the ninth cylinder 403 is extended to lower the receiving member 404. Thus, the upper and lower molds are taken out of the upper flask 2 and lower flask 3, respectively. Then, the fifth cylinder 22 is extended to elevate the upper squeezing member 4. Then, the extruding cylinder 406 is extended to push the piled upper and lower molds out of the receiving member 404. Therefore, piled upper and lower molds are obtained.

By the present invention, the degree of the accuracy in the core-setting is kept higher because the core N is set within the body A of the molding machine, which is rigid and has a high accuracy. The jig for the core 501 is just transported to a position near the match plate 1 and between the upper flask 2 and the lower flask 3 in the body A so that the core N faces downward. In a conventional molding machine, the core-setting is performed such that the lower flask is carried out of the molding machine, that is, it is elevated on a cantilever. Thus, the accuracy deteriorates. In addition, by the present invention, the configuration of the molding machine is simplified, because the core-setting is performed within the body A of the molding machine, and so no means for longitudinally transporting the lower flask is required.

In the molding machine of the present invention, the elevating actuator, namely, the third cylinder 20, is attached to the body A and elevates the match plate 1 between the upper flask 2 and the lower flask 3. It also elevates the jig for the core 501 and the carriage for the core 502, which are transported to the position between the upper flask 2 and the lower flask 3. Thus, advantageous effects, such as reducing the number of actuators and making a machine smaller, are obtained.

In the molding machine of the present invention, the mechanism for transporting a Match plate G is disposed at one side of the holding station S1, which clamps the match plate 1 between the upper flask 2 and the lower flask 3. The mechanism for transporting the jig for the core E, which transports the jig for the core 501 and the carriage for the core 502 to and from the position above the lower mold, is disposed at another side. Thus, the jig for the core 501 can hold the core N concurrently with the operations of the mechanism for transporting a match plate G, the mold stripping means D, etc.

The molding machine of the present invention comprises the jig for transporting the core 601, which is transported to the position below the jig for the core 501, and then elevated. Thus, if the jig for transporting the core 601 is empty at the end of the contracted lateral cylinder 606, an operator can place the core N on the upper plane 601*a* of the jig for transporting the core 601 concurrently with the operations of the mechanism for transporting the jig for the core E as well as the mechanism for transporting a match plate G, the mold stripping means D, etc. Therefore, sufficient time is reserved for an operator to place the core N on the plane 601*a*.

In the second embodiment, the core N, which is held by the jig for the core 501 by means of the carriage for the core 502, is lowered to the position nearly abutting the lower mold. This does not limit the scope of the invention. The core may be lowered to abut the lower mold.

In the second embodiment, the core N, which is held by the jig for the core 501 by means of the carriage for the core 502, is lowered to the position nearly or actually abutting the lower mold). Then the operation of the suctioning means is stopped to release the core N from the jig for the core 501 while the core N is lowered. Thus, the core N is set on the lower mold. However, this does not limit the scope of the invention. It is preferable to set the core N on the lower mold by pressuring it with compressed air after stopping the operation of the suctioning means, because any fault in releasing the core N is prevented. Thus the certainty of releasing the core N increases. To press the core N with compressed air, the suction and compression means may be substituted for the suctioning means as the means for holding a core.

In the second embodiment, the jig for transporting the core 601 is elevated by the elevating cylinders 607, 607 by means of the elevating frame 605. This does not limit the scope of the invention. The jig for transporting the core 601 may be directly held by an elevating means (not shown) without the use of the elevating frame 605.

The invention claimed is:

1. An apparatus for setting a core in a molding machine, the molding machine having an upper flask, a lower flask, a match plate that can be clamped between the upper flask and the lower flask, an upper and lower squeezing member for forming upper and lower molding spaces by having the upper and lower squeezing members inserted into the upper and lower flasks, respectively an actuator attached to the molding machine for raising and lowering the match plate with respect to the lower flask after the match plate has been transported to a position between the upper and lower flasks, wherein a core is set in a lower mold formed in the lower molding space when an upper mold formed in the upper molding space, the lower mold, and the match plate are separate from each other, the apparatus for setting a core comprising:

a jig for a core having a means for holding a core, wherein the means for holding the core holds the core on the jig for a core and releases the core from the jig for a core to place the core on the lower mold; and a carriage for a core being connected to the jig for a core and being moveable to and from a position above the lower mold;

wherein the actuator for raising and lowering the match plate also raises and lowers the jig for a core and the carriage for a core after the jig for a core and the carriage for a core are transported to a position above the lower mold.

2. The apparatus for setting a core in a molding machine of claim 1, comprising:

a jig for transporting a core to and from a position below the jig for a core, the jig for transporting a core elevating the core to the jig for a core so that the core can be held by the means for holding a core of the jig for a core.

3. A molding machine comprising:

the apparatus for setting a core in a molding machine of claim 1 or 2;

a mechanism for transporting the match plate to and from a position between the upper and lower flasks at one side of a molding station for clamping the match plate between the upper flask and the lower flask; and a mechanism for transporting the jig for a core and the carriage for a core to and from a position above the lower mold at another side of the molding station, the mechanism for transporting the jig for a core and the carriage for a core facing the mechanism for transporting the match plate.

* * * * *